US009596931B1

(12) United States Patent
Nimgulkar et al.

(10) Patent No.: US 9,596,931 B1
(45) Date of Patent: Mar. 21, 2017

(54) BASKET AND RAIL ASSEMBLIES

(71) Applicant: CLAIRSON, INC., Newark, DE (US)

(72) Inventors: Milind Sahebrao Nimgulkar, Pune (IN); Gajanan Ramkishan Muttepawar, Pune (IN); Harishchandra Namdeo Dahatonde, Pune (IN)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 15/131,323

(22) Filed: Apr. 18, 2016

(51) Int. Cl.
*A47F 3/14* (2006.01)
*A47B 88/08* (2006.01)
*A47B 88/04* (2006.01)

(52) U.S. Cl.
CPC ..... *A47B 88/08* (2013.01); *A47B 2088/0448* (2013.01); *A47B 2210/0024* (2013.01); *A47B 2210/0059* (2013.01); *A47B 2210/04* (2013.01); *A47B 2210/09* (2013.01)

(58) Field of Classification Search
CPC ..... A47B 2210/0024; A47B 2210/097; A47B 2210/04; A47B 2210/0059; A47B 2210/09; A47B 2210/05; A47B 2210/091; A47B 2210/092; A47B 2210/094; A47B 88/08; A47B 2088/0448
USPC ..... 211/126.15, 133.5, 162, 85.29, 153, 211/181.1; 312/402, 404, 410, 228.1; D6/566; D3/304, 306, 307, 308, 309, D3/312, 315
See application file for complete search history.

(56) References Cited

U.S. PATENT DOCUMENTS 1,938,217 A * 12/1933 Darbyshire ..... A47B 96/06 211/153
1,995,399 A * 3/1935 Reedy ..... F24C 15/16 126/339
2,103,885 A * 12/1937 Whalen ..... F25D 25/021 211/134
2,633,400 A * 3/1953 Ring ..... F24C 15/16 126/339
D264,761 S * 6/1982 Dekarski ..... D3/306
D296,601 S * 7/1988 Chap ..... D3/306
5,036,990 A * 8/1991 Verchere ..... A47B 77/16 211/113
5,086,936 A * 2/1992 Remmers ..... A47B 67/04 211/126.15
5,181,621 A * 1/1993 Plaehn ..... A47K 5/04 211/119.011
5,224,610 A * 7/1993 Veazey ..... A47F 5/0846 211/162
5,303,997 A * 4/1994 Kropf ..... A47B 88/402 312/334.4
5,330,063 A * 7/1994 Remmers ..... A47B 88/402 211/126.15

(Continued)

*Primary Examiner* — Joshua J Michener
*Assistant Examiner* — Devin Barnett
(74) *Attorney, Agent, or Firm* — Harness, Dickey & Pierce, P.L.C.

(57) ABSTRACT

Example embodiments of the present disclosure generally relate to basket and rail assemblies. In one example embodiment, a basket and rail assembly generally includes a slide rail, a basket including a plurality of wires, and at least one support configured to be coupled to the slide rail. The support includes at least one groove configured for receiving at least one wire of the plurality of wires of the basket for releasably coupling the basket to the slide rail.

12 Claims, 26 Drawing Sheets

(56) References Cited

U.S. PATENT DOCUMENTS 5,457,867 A * 10/1995 Maberry ..... A47B 88/43 29/525
D395,548 S * 6/1998 Morissette ..... D3/304
D438,042 S * 2/2001 Hofman ..... D3/306
6,238,031 B1 * 5/2001 Weng ..... A47B 88/407 312/333
6,341,704 B1 * 1/2002 Michel, Jr. ..... A47J 47/20 211/119
6,491,173 B1 12/2002 Costa
6,505,745 B1 * 1/2003 Anderson ..... A47G 21/16 211/181.1
6,578,720 B1 * 6/2003 Wang ..... A47F 5/01 211/126.15
D477,144 S * 7/2003 Remmers ..... D3/306
6,679,392 B1 * 1/2004 Costa ..... A47B 61/003 211/162
6,840,593 B2 * 1/2005 Remmers ..... A47B 88/427 211/126.15
D507,108 S * 7/2005 Suero, Jr. ..... D3/304
6,938,617 B2 * 9/2005 Le ..... F24C 15/16 126/273 R
D512,223 S * 12/2005 Snell ..... D3/304
7,108,143 B1 * 9/2006 Lin ..... A47B 88/40 211/126.15
D540,091 S * 4/2007 Snell ..... D6/566
7,216,646 B2 * 5/2007 Le ..... F24C 15/16 126/273 R
D546,101 S * 7/2007 Knight ..... D6/705.6
D555,943 S * 11/2007 Butler ..... D3/306
7,406,833 B2 * 8/2008 Ertz ..... F25D 23/021 62/115
7,448,508 B2 * 11/2008 Babucke ..... F24C 15/16 211/126.9
D587,038 S * 2/2009 Goodman ..... D6/678.4
7,802,709 B1 * 9/2010 Lewis ..... B60R 9/00 224/401
7,950,754 B2 * 5/2011 Brown ..... F25D 25/025 312/330.1
8,028,844 B2 10/2011 Costa et al.
D650,175 S * 12/2011 Lee ..... D3/306
8,210,371 B2 * 7/2012 Kim ..... F25D 25/022 211/126.15
8,297,726 B2 * 10/2012 Ramm ..... A47B 51/00 312/408
8,333,447 B2 * 12/2012 Moody ..... F25D 23/021 312/301
D675,466 S * 2/2013 Goodman ..... D6/566
8,490,801 B2 * 7/2013 Smith ..... F24C 15/16 126/339
D692,666 S * 11/2013 Goodman ..... D3/304
D698,186 S * 1/2014 Funchess ..... D6/552
8,671,712 B2 * 3/2014 Noel ..... F25D 25/025 312/330.1
8,746,470 B2 * 6/2014 Reinbigler ..... A47B 57/04 211/126.15
D710,124 S * 8/2014 Goodman ..... D3/306
D717,070 S * 11/2014 Callif ..... D6/553
9,022,496 B2 * 5/2015 Armstrong ..... F24C 15/16 312/319.3
9,052,118 B2 * 6/2015 Metcalf ..... F24C 15/16
D734,610 S * 7/2015 Christie ..... D3/304
D747,876 S * 1/2016 Goodman ..... D3/306
D758,732 S * 6/2016 Goodman ..... D3/306
2002/0033657 A1 * 3/2002 Kim ..... A47B 88/493 312/334.12
2002/0125802 A1 * 9/2002 Remmers ..... A47B 88/402 312/334.7
2004/0174102 A1 * 9/2004 Chen ..... A47B 88/487 312/334.46
2005/0167381 A1 * 8/2005 Fariello ..... A47J 36/2405 211/181.1
2005/0174022 A1 * 8/2005 Kuttalek ..... A47B 88/487 312/410
2006/0152118 A1 * 7/2006 Lee ..... F25D 25/022 312/404
2006/0260353 A1 * 11/2006 Uihlein ..... F25D 23/021 62/441
2007/0235401 A1 * 10/2007 Costa ..... A47F 3/147 211/126.15
2008/0054772 A1 * 3/2008 Koloff ..... A47B 88/40 312/404
2009/0200906 A1 * 8/2009 Dao ..... F24C 15/16 312/410
2009/0211997 A1 * 8/2009 Sparkowski ..... A47F 5/0018 211/153
2010/0213805 A1 * 8/2010 Brown ..... F25D 23/064 312/404
2012/0093445 A1 * 4/2012 Haxton ..... A47B 88/49 384/21
2012/0139402 A1 * 6/2012 Haidar ..... F25D 25/025 312/404
2012/0146476 A1 * 6/2012 Tibbe ..... A47B 88/42 312/334.8
2013/0093306 A1 * 4/2013 Shin ..... F25D 23/021 312/404
2013/0256250 A1 * 10/2013 Hirsh ..... A47F 5/01 211/181.1
2014/0283814 A1 * 9/2014 Armstrong ..... F24C 15/16 126/339
2014/0291266 A1 * 10/2014 Yang ..... A47B 96/00 211/126.15
2014/0327352 A1 * 11/2014 Chen ..... E05D 15/0686 312/334.46
2015/0173588 A1 * 6/2015 Bhajak ..... A47L 15/4246 312/228.1
2015/0208801 A1 * 7/2015 Hu ..... A47B 88/931 312/334.27
2015/0208802 A1 * 7/2015 Yoneda ..... A47B 88/04 312/333
2016/0144999 A1 * 5/2016 Tang ..... B65D 7/14 220/493
2017/0000260 A1 * 1/2017 Hashemi ..... F16C 29/048

* cited by examiner

BASKET AND RAIL ASSEMBLIES

CROSS-REFERENCE TO RELATED APPLICATION

This application claims the benefit and priority of India Patent Application No. 201621007648 filed Mar. 4, 2016. The entire disclosure of the above application is incorporated herein by reference.

FIELD

The present disclosure generally relates to basket and rail assemblies.

BACKGROUND

This section provides background information related to the present disclosure which is not necessarily prior art.

Efficient and organized use of building space is very desirable, particularly with respect to storage or utility space in both businesses and residential settings. Because of limited or tight spaces in these locations, maximizing the amount of useable space is very important. Likewise, providing ease in accessing stored items is important. Further, ease in moving stored items to make room for other items or to access items not readily accessible, is likewise important.

DRAWINGS

The drawings described herein are for illustrative purposes only of selected embodiments and not all possible implementations, and are not intended to limit the scope of the present disclosure.

Figure 21:
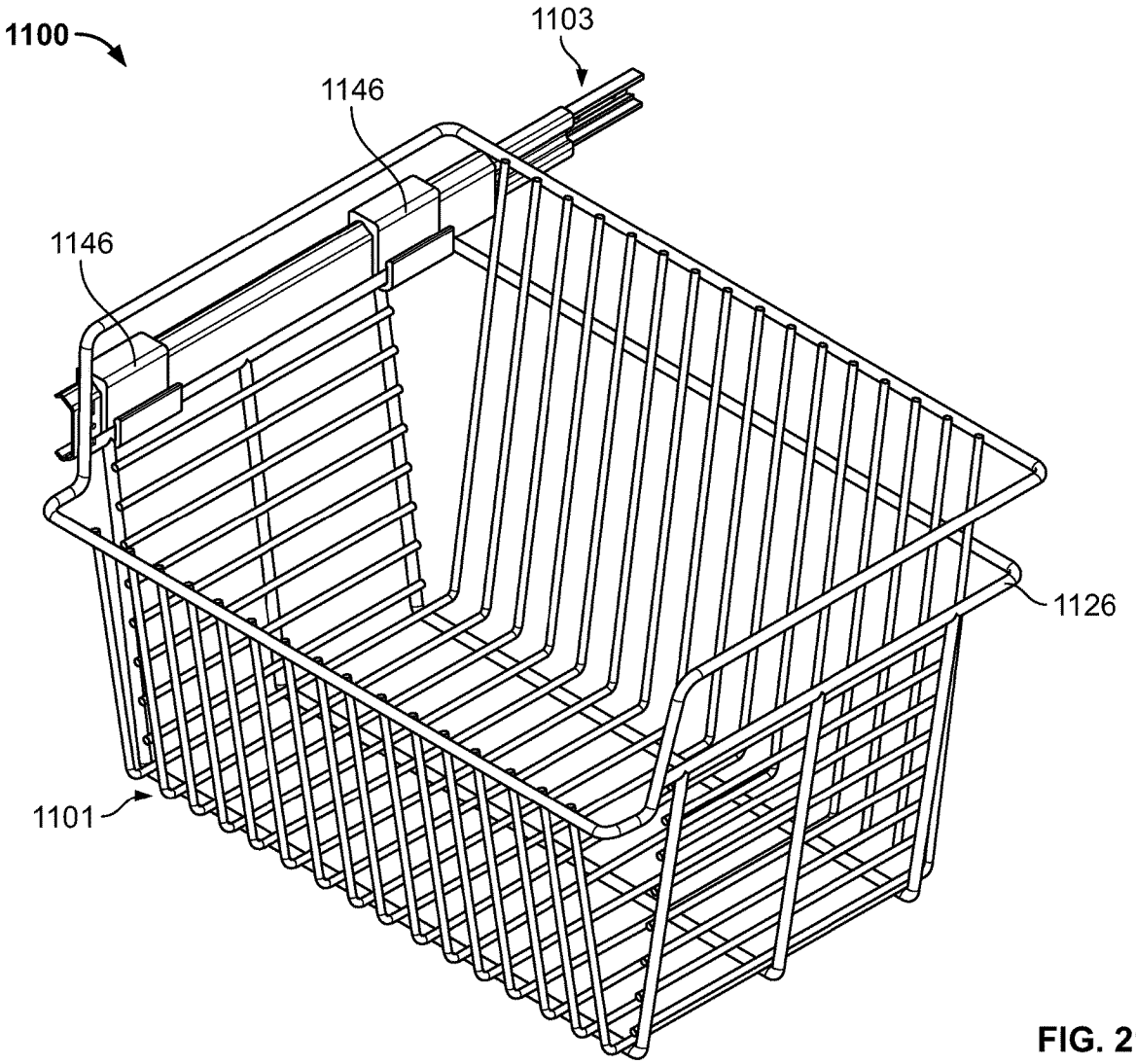
Figure 22:
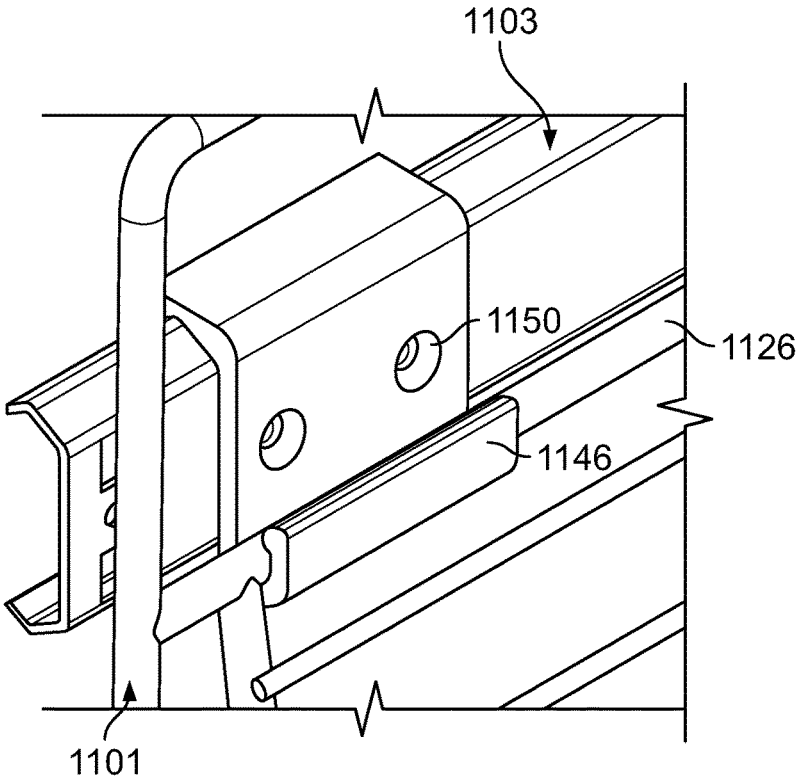
Figure 23:
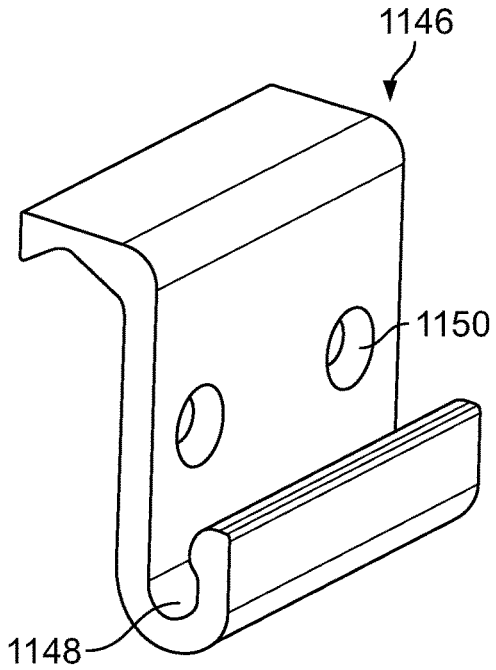
Figure 24:
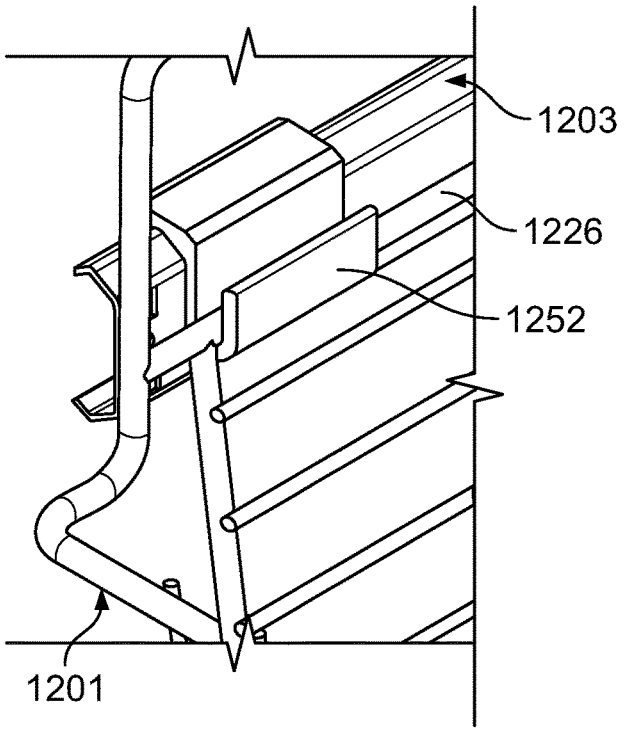
Figure 25:
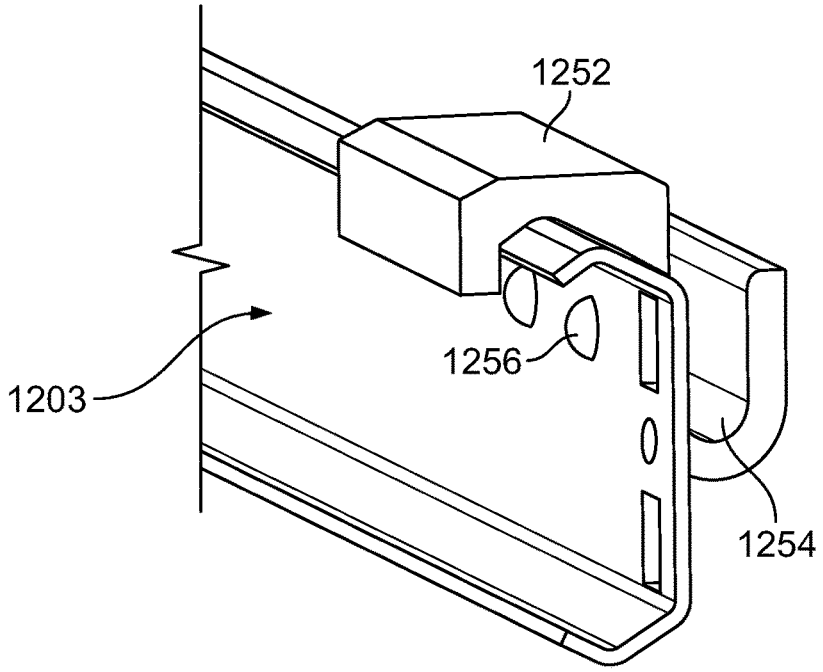
Figure 26:
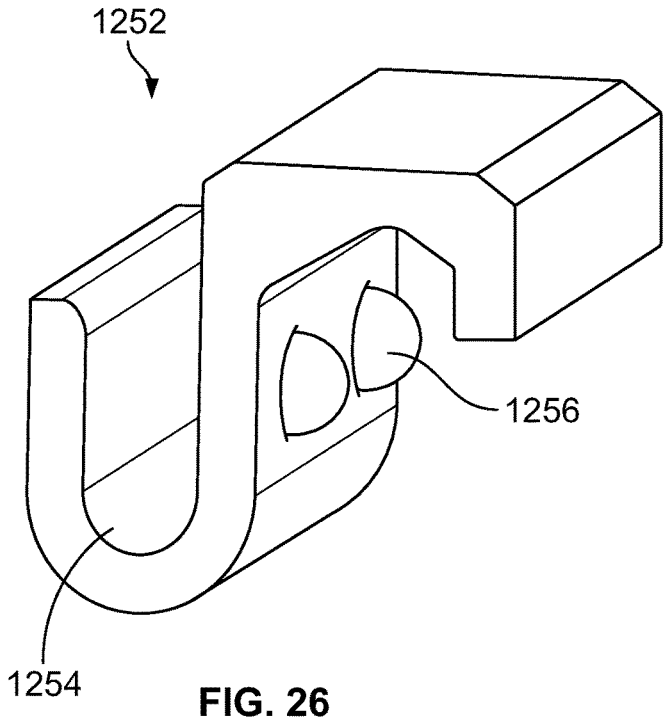
Figure 27:
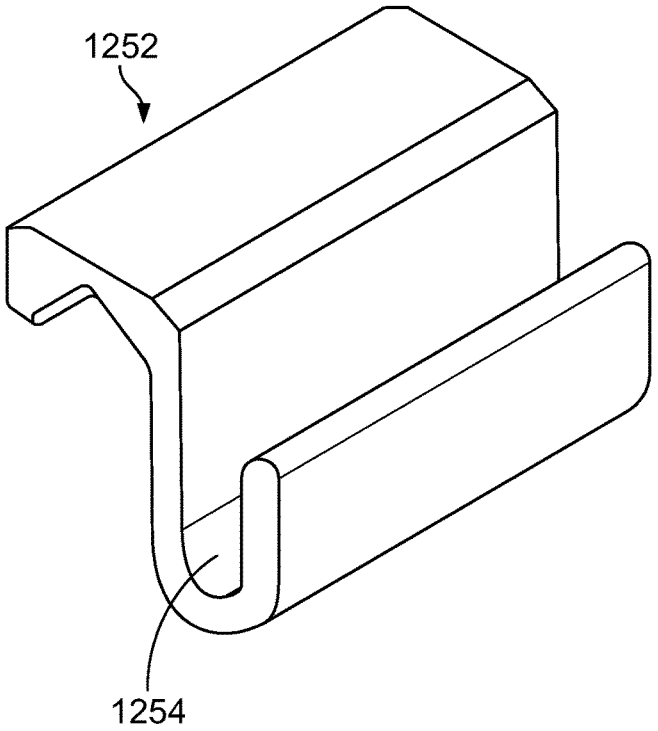
Figure 29:
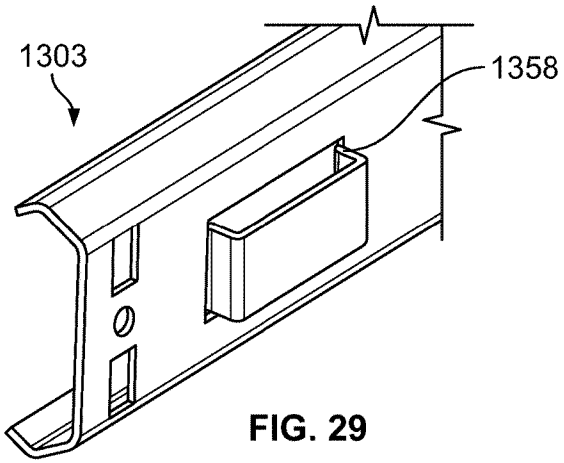
Figure 30:
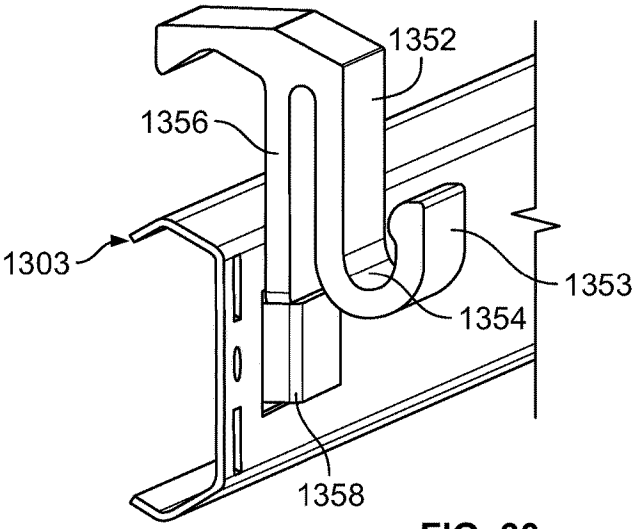
Figure 28:
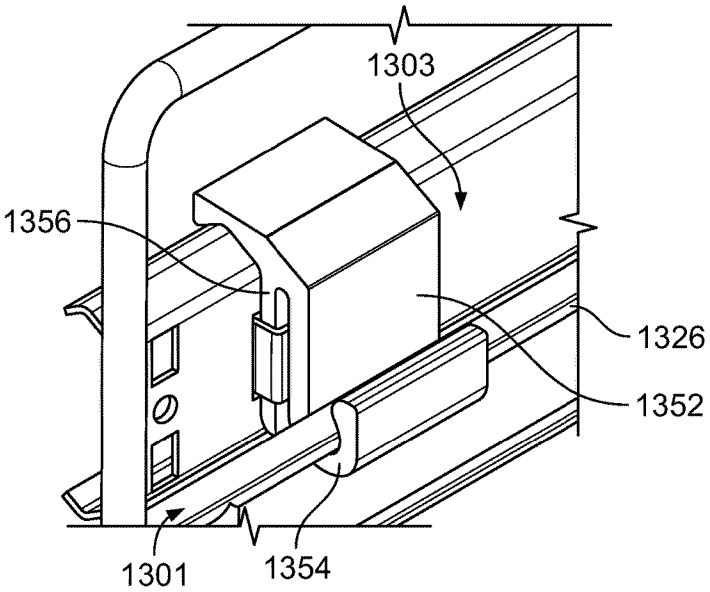
Figure 31:
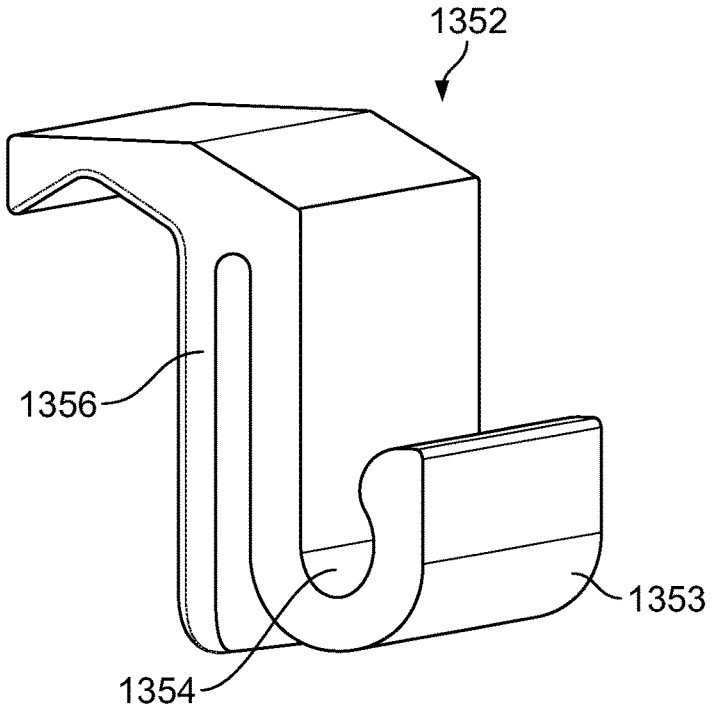
Figure 32:
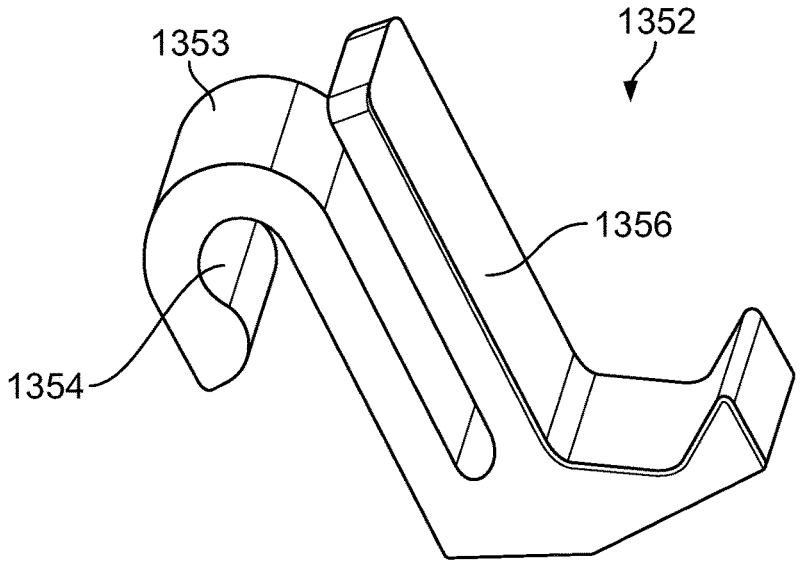
Figure 33:
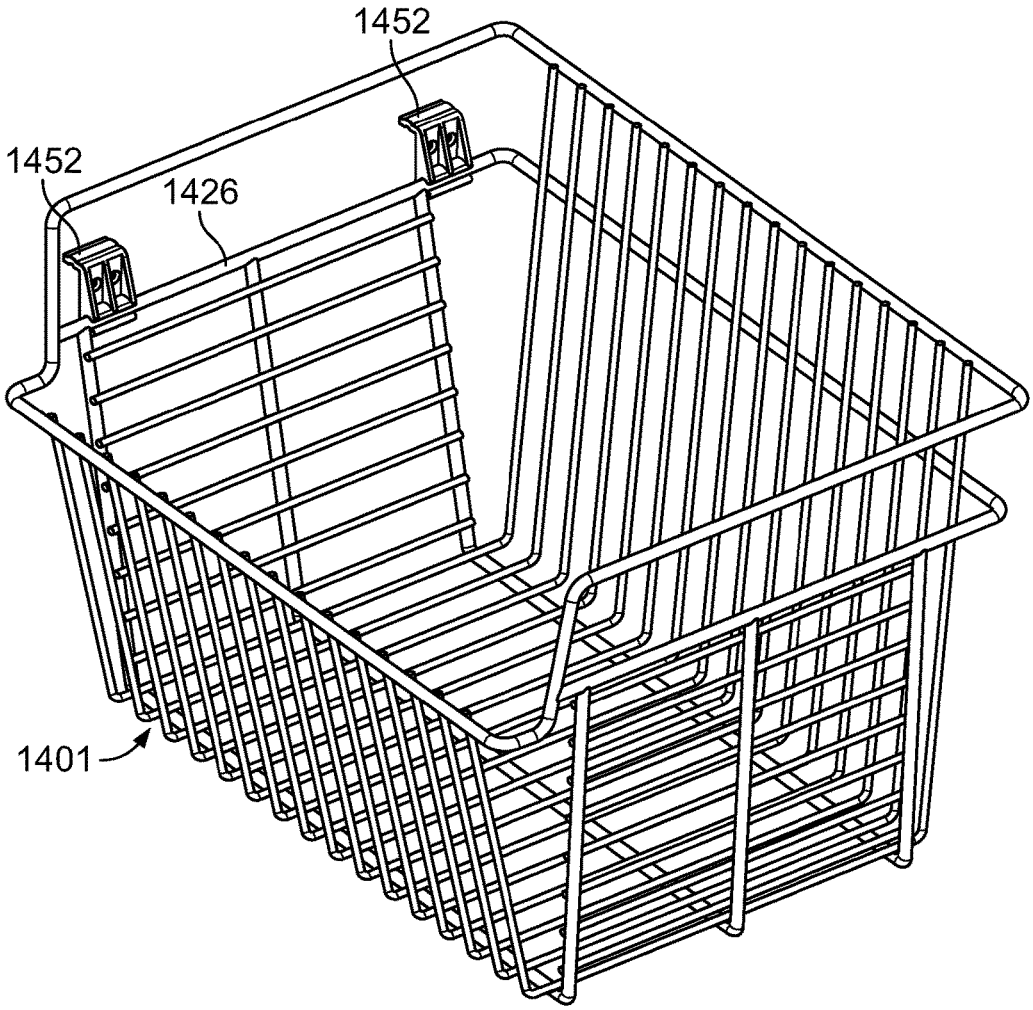
Figure 34:
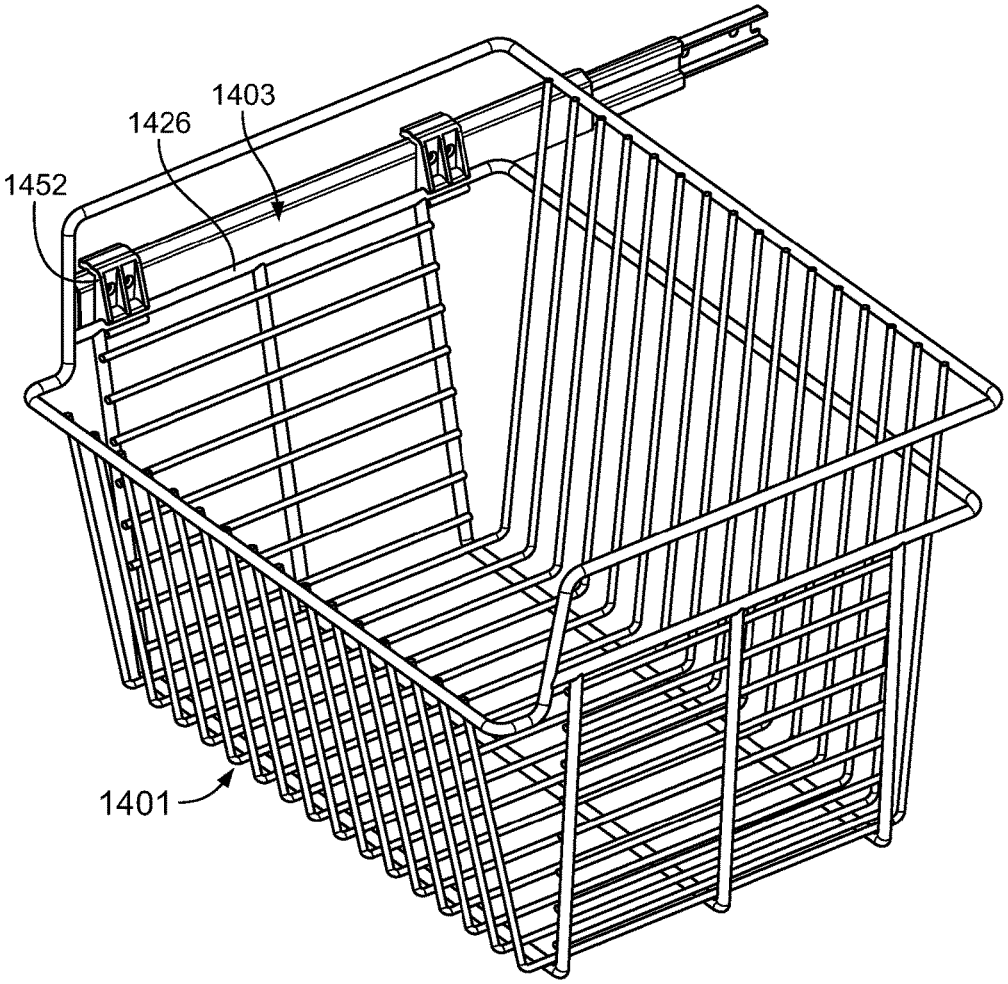
Figure 35:
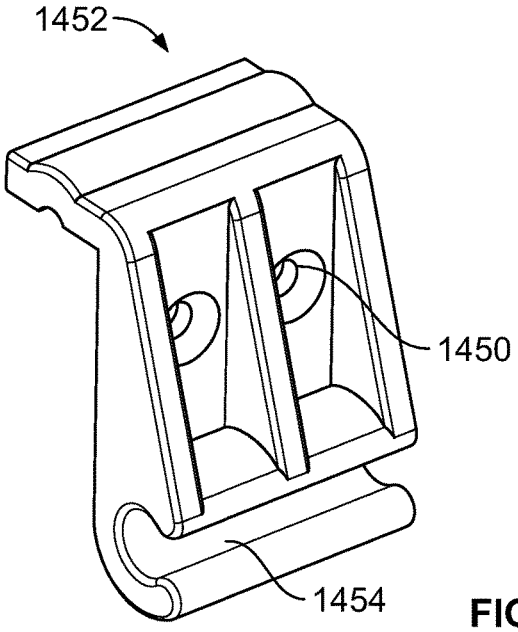
Figure 36:
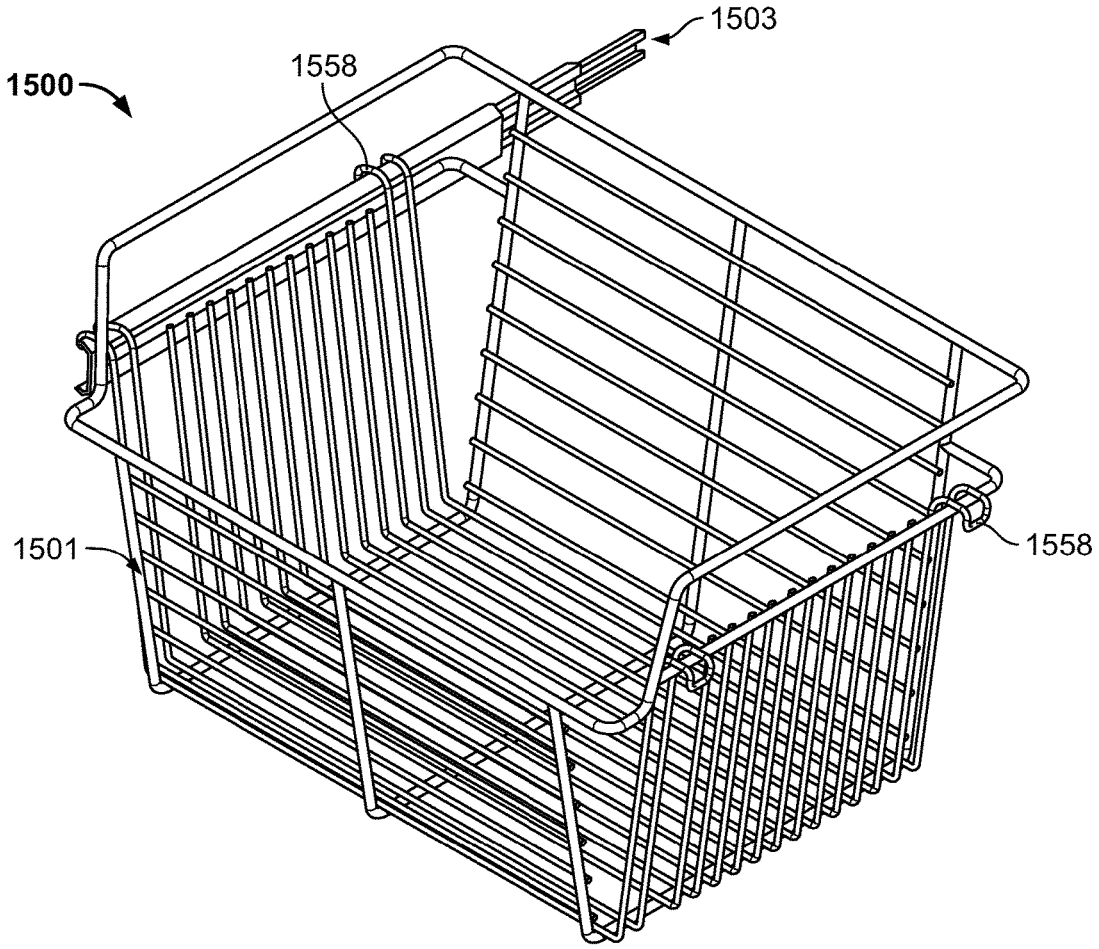
Figure 37:
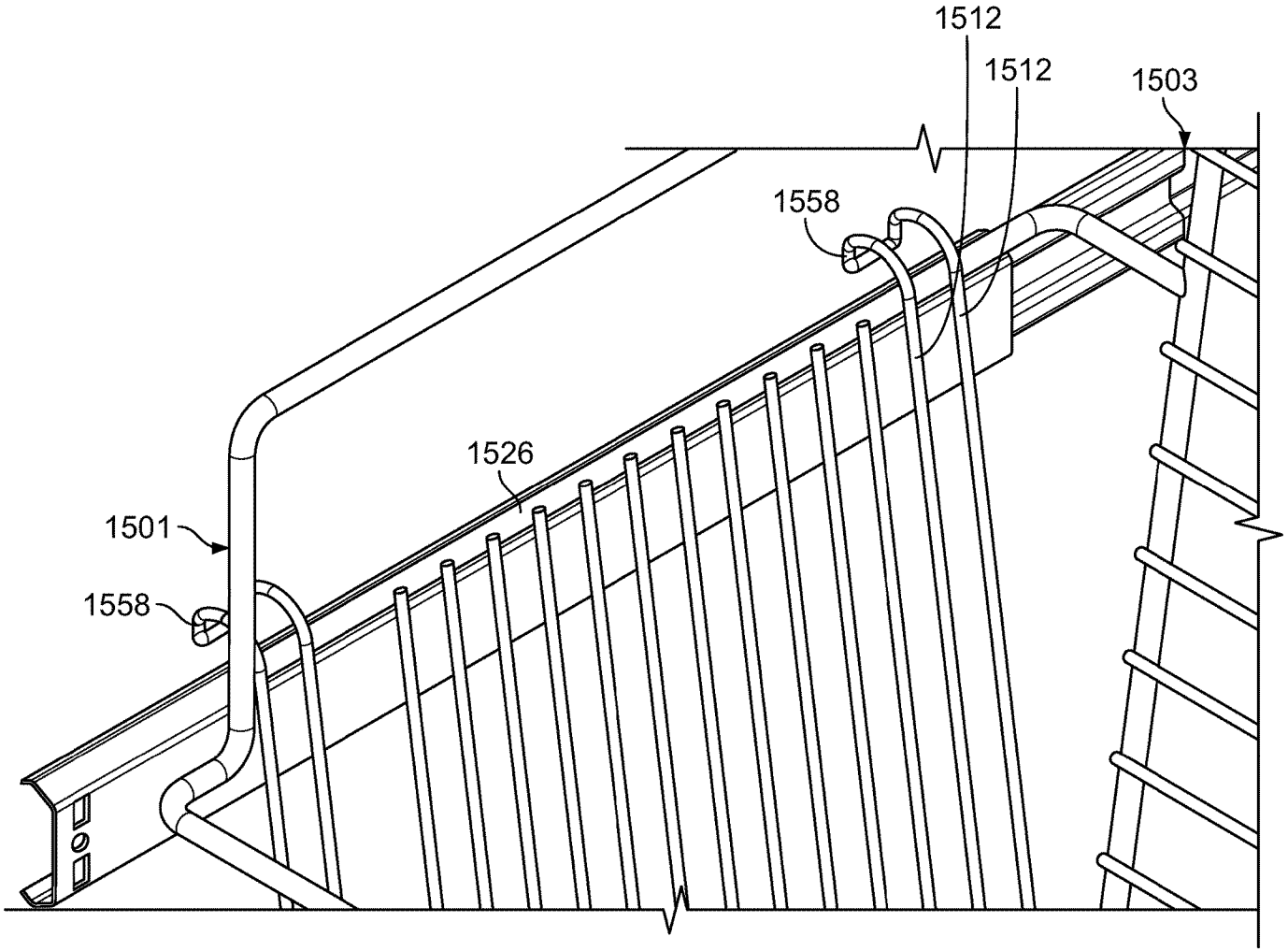
Figure 38:
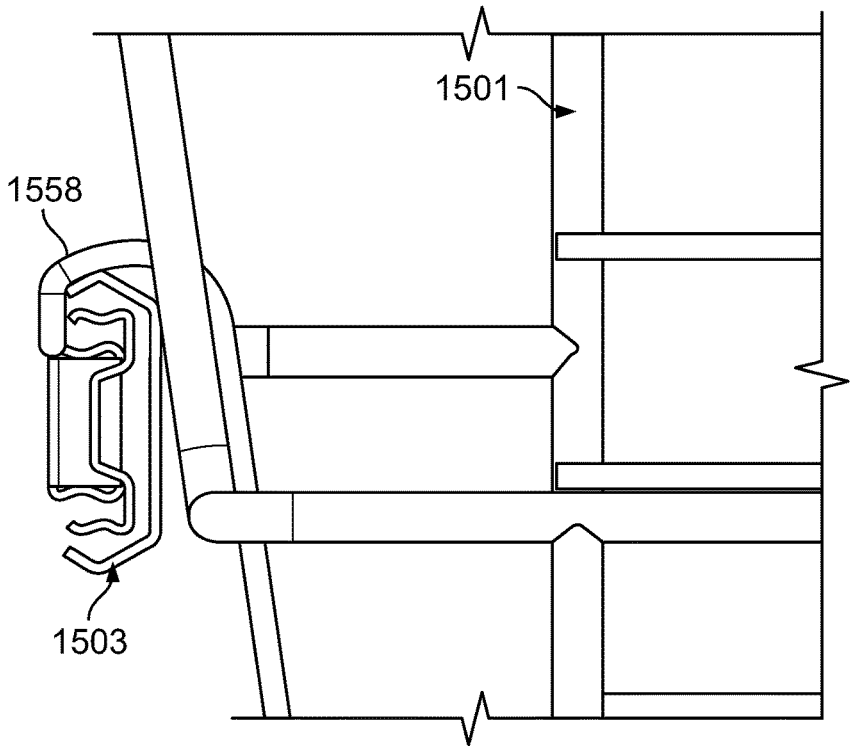
Figure 39:
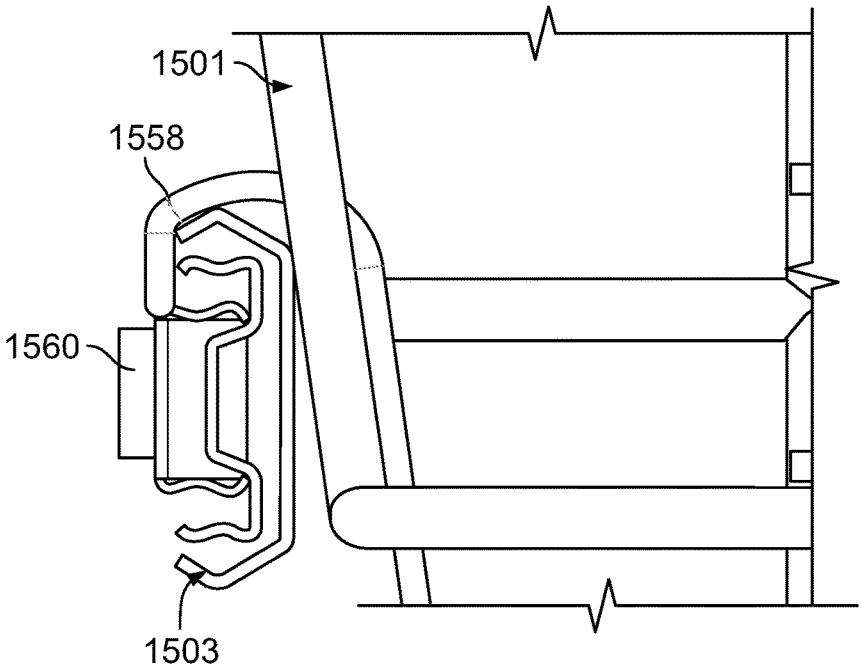
Figure 41:
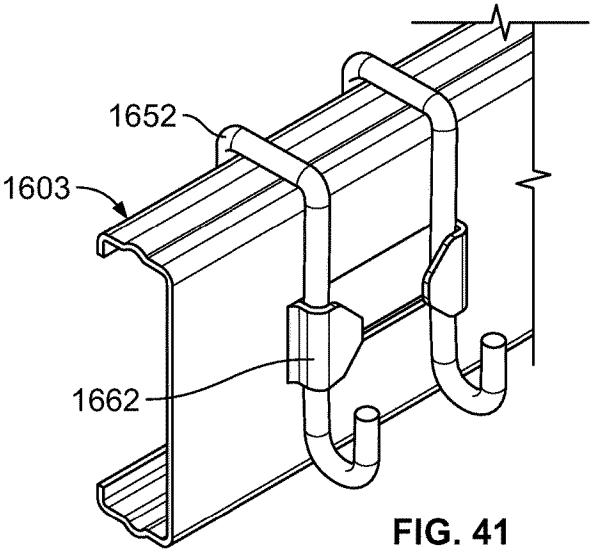
Figure 40:
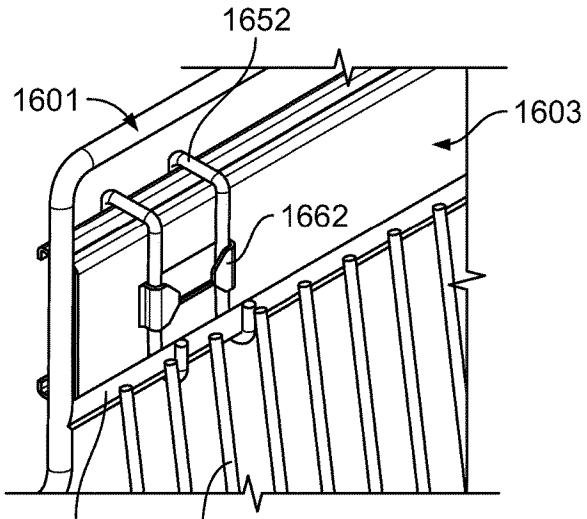
Figure 44:
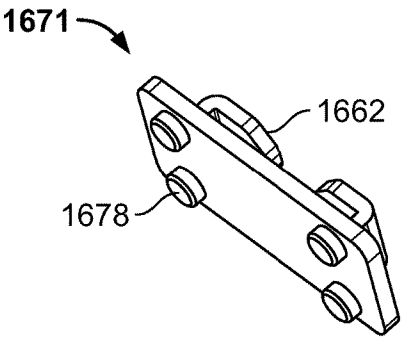
Figure 43:
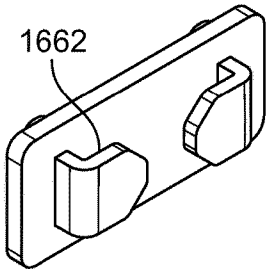
Figure 42:
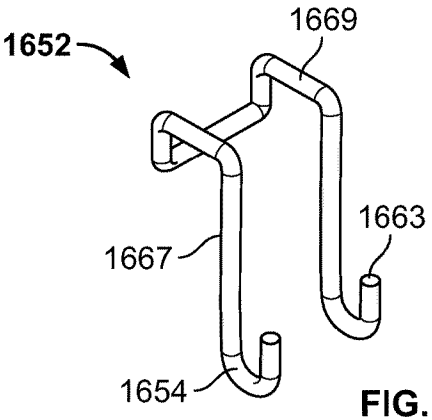
Figure 46:
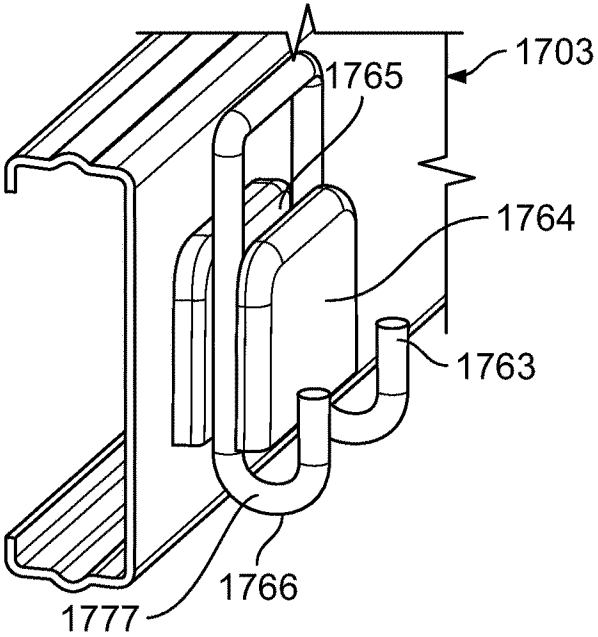
Figure 45:
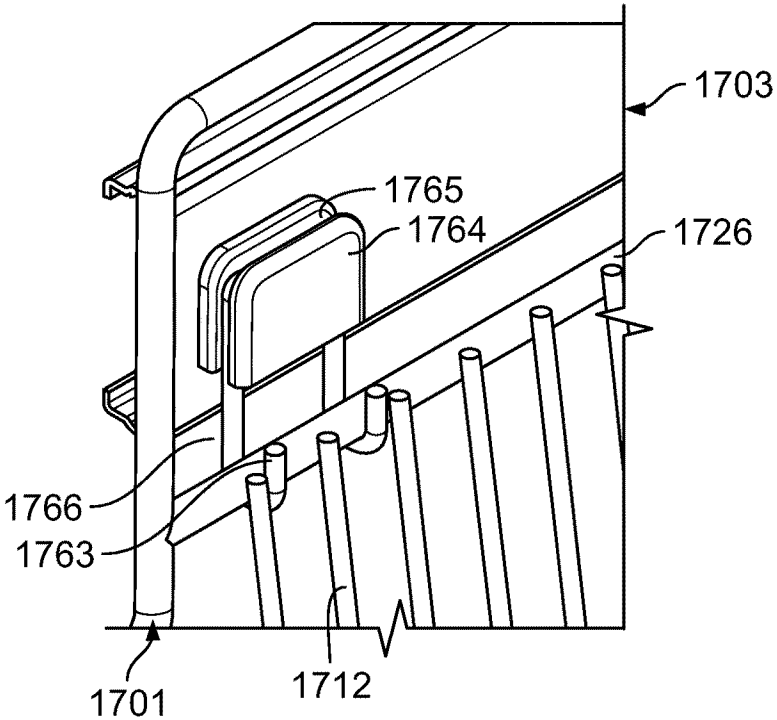
Figure 47:
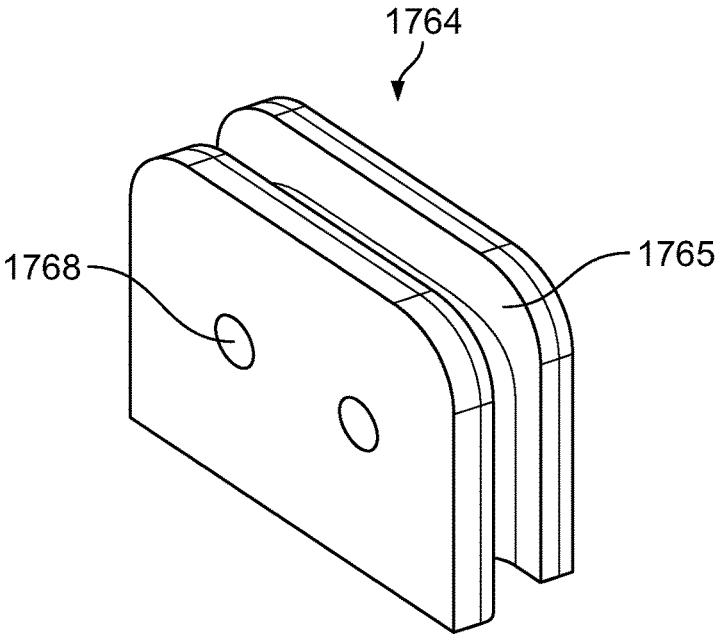
Figure 48:
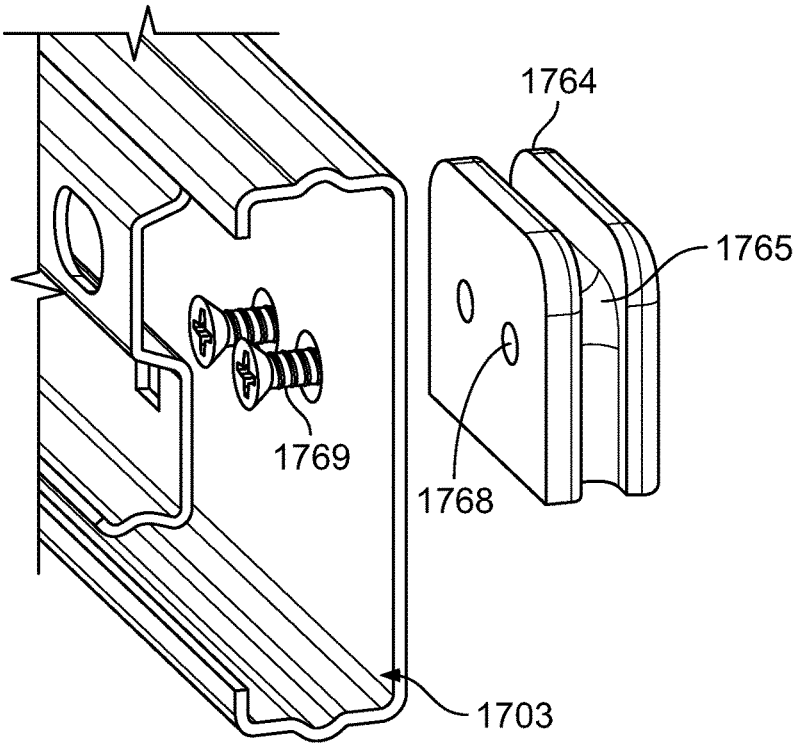
Figure 49:
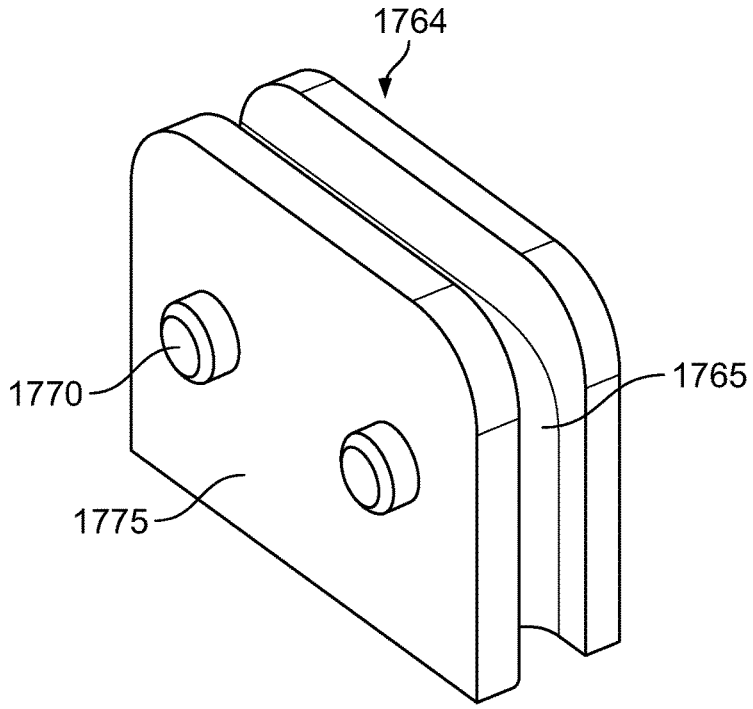
Figure 50:
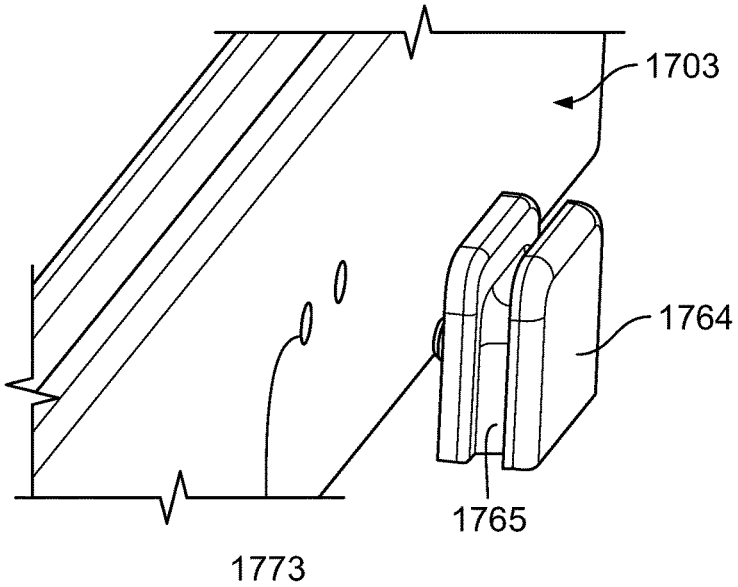

FIGS. 17, 18, 19, and 20 are perspective views of baskets according to exemplary embodiments;

FIG. 21 is a perspective view of a basket and rail assembly according to an exemplary embodiment;

FIG. 22 is a perspective view of a portion of the basket and rail assembly shown in FIG. 21, and illustrating a support coupling the basket to the rail assembly;

FIG. 23 is a perspective view of the support shown in FIG. 22;

FIG. 24 is a perspective view of a portion of a basket and rail assembly according to an exemplary embodiment, and illustrating a support coupling the basket to the rail assembly;

FIG. 25 is a perspective view showing the support coupled to the rail assembly shown in FIG. 24;

FIGS. 26 and 27 are perspective views of the support shown in FIGS. 24 and 25;

FIG. 28 is a perspective view showing a portion of a basket and rail assembly according to an exemplary embodiment, and illustrating a support coupling the basket to the rail assembly;

FIG. 29 is a perspective view showing a portion of the rail assembly shown in FIG. 28, and illustrating a slot of the rail assembly that is configured for receiving a portion of the support therein;

FIG. 30 is a perspective view showing a support aligned with a slot of a rail assembly, and illustrating a tab of the support being positioned within the slot to thereby couple the support to the rail assembly;

FIGS. 31 and 32 are perspective views of the support shown in FIG. 30;

FIG. 33 is a perspective view of a basket and two supports coupled to the basket according to an exemplary embodiment;

FIG. 34 is a perspective view of the basket shown in FIG. 33 after being coupled to a slide rail assembly via the two supports;

FIG. 35 is a perspective view of a support shown in FIG. 34;

FIG. 36 is a perspective view of a basket having integral hooks according to an exemplary embodiment, and illustrating the basket coupled to a slide rail assembly via two integral hooks;

FIG. 37 is a perspective view of a portion of the basket shown in FIG. 36, and showing two integral hooks of the basket aligned with and over the slide rail assembly;

FIG. 38 is a front view of a portion of the basket and slide rail assembly shown in FIG. 37 after the basket has been moved downward relative to the slide rail assembly to position the basket's integral hooks over a top surface of the slide rail assembly and thereby couple the basket to the slide rail assembly;

FIG. 39 is a front view of a portion of the basket and slide rail assembly shown in FIG. 38, and also showing a spacer according to another exemplary embodiment;

FIG. 40 is a perspective view of a portion of a basket coupled to a slide rail assembly by a hook according to an exemplary embodiment;

FIG. 41 is a perspective view of the hook and slide rail assembly shown in FIG. 40;

FIG. 42 is a perspective view of the hook shown in FIG. 41;

FIGS. 43 and 44 are perspective views of a component that may be coupled to a slide rail assembly for receiving portions of the hook shown in FIG. 42 according to an exemplary embodiment;

FIG. 45 is a perspective view of a portion of a basket coupled to a slide rail assembly by a hook and a support according to an exemplary embodiment;

FIG. 46 is a perspective view of the support coupled to the slide rail assembly shown in FIG. 45, and also illustrating the hook prior to being moved fully downward onto the support;

FIG. 47 is a perspective view of the support shown in FIGS. 45 and 46;

FIG. 48 is a perspective view showing an exemplary way the support shown in FIG. 47 may be coupled to a slide rail assembly using screws;

FIG. 49 is a perspective view of the support shown in FIGS. 45 and 46 where the support includes two outwardly projecting portions instead of holes according to an exemplary embodiment; and FIG. 50 is a perspective view showing an exemplary way that the support shown in FIG. 49 may be coupled to a slide rail assembly by inserting the outwardly projecting portions of the support into holes in the slide rail assembly.

Corresponding reference numerals indicate corresponding parts throughout the several views of the drawings.

DETAILED DESCRIPTION

Example embodiments will now be described more fully with reference to the accompanying drawings.

Example embodiments described herein include basket and rail assemblies that can be used to store items. The baskets and rail assemblies may be part of a storage system, which may be included in a closet, enclosure, free-standing unit, etc. The baskets and rail assemblies may provide more efficient storage of items, increased storage capacity, improved utilization of storage space, easier access to items stored in the basket(s), etc. The rail assemblies may allow baskets to be stored in a storage position when not in use, and moved to an access position when a user would like to add or remove items from the basket. The baskets may be releasably coupled to the rail assemblies so that the baskets are removable to provide greater access to the basket contents, to change baskets in a rail assembly, to construct or deconstruct a basket and rail assembly, etc.

Figure 1:
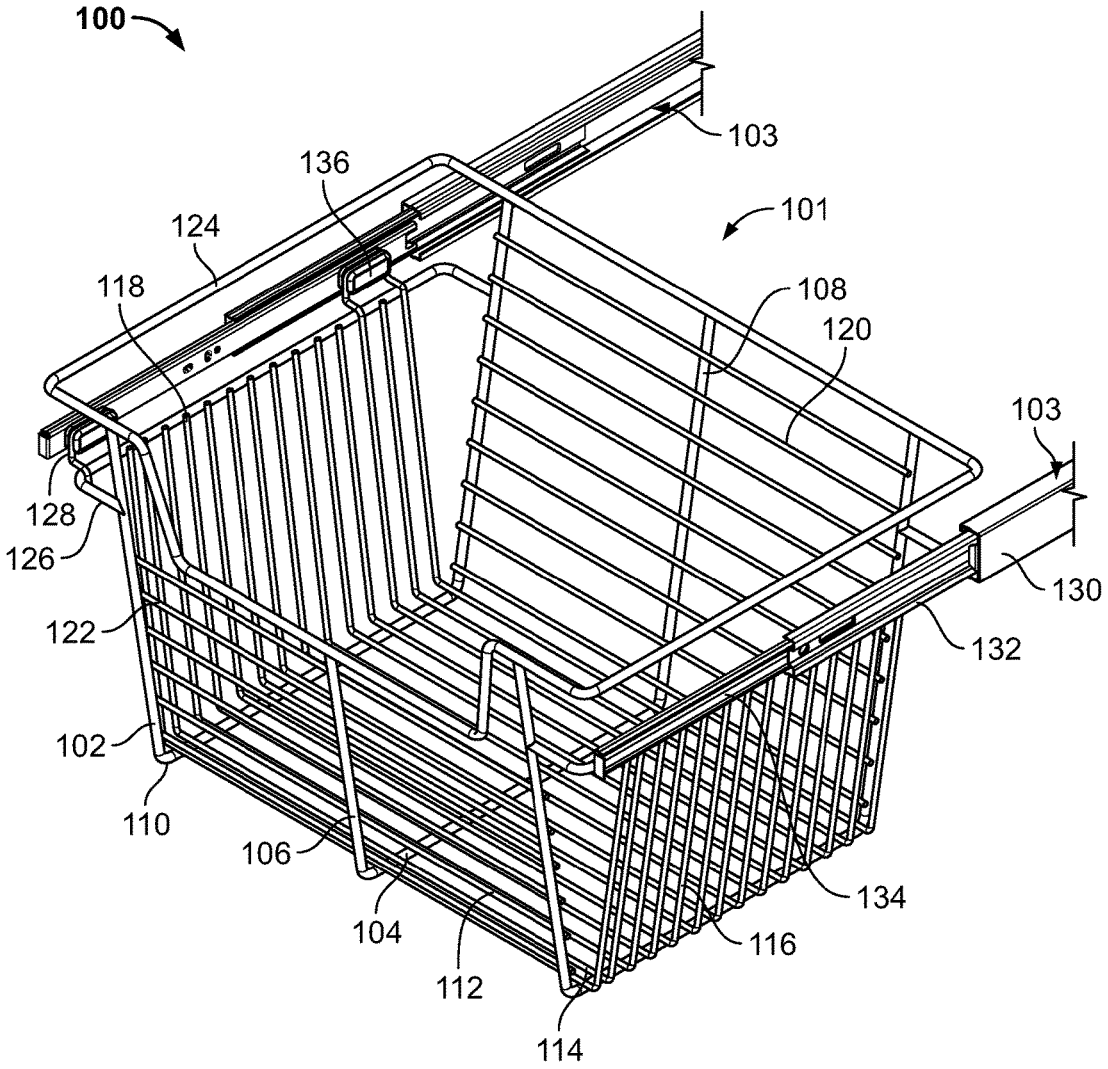
FIG. 1 is a perspective view of a basket and rail assembly according to an exemplary embodiment.
Figure 2:
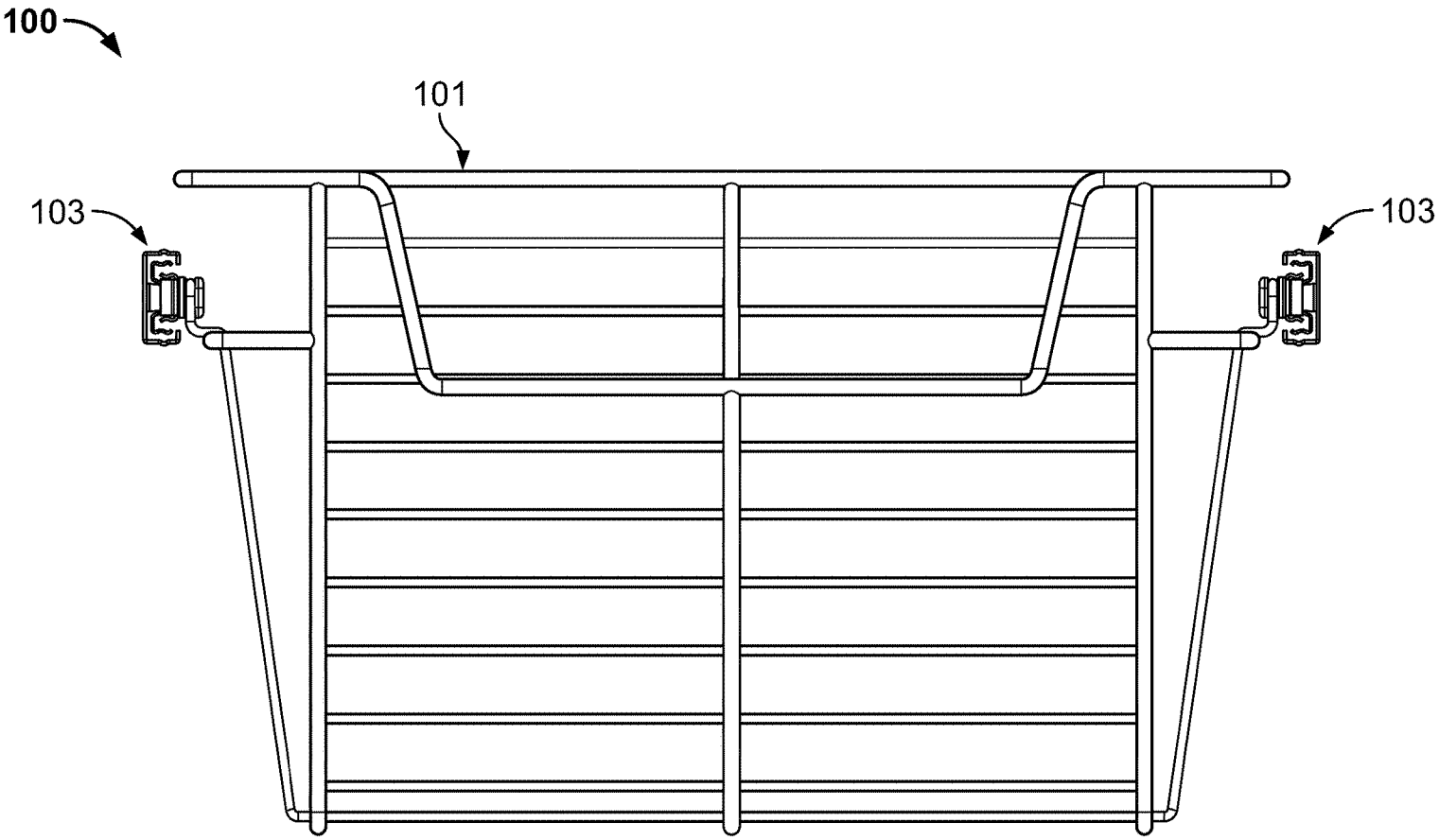
FIG. 2 is a front view of the basket and rail assembly shown in FIG. 1.

With reference now to the figures, FIG. 1 illustrates an example embodiment of a basket and rail assembly 100 embodying one or more aspects of the present disclosure. The assembly 100 includes a basket 101 that is coupled to and between two rail assemblies 103. As disclosed herein, the basket 101 includes hooks or hook portions 128 (e.g., integral wire hook portions, etc.) that may be used to couple the basket to supports or holders 136 along the slide rails 134 of the rail assemblies 103.

As shown in FIG. 1, the basket 101 includes support wires 102 (broadly, support members). The support wires 102 may be substantially parallel to one another. Each support wire 102 includes a middle portion 104, a front portion 106 extending upwards from the middle portion 104, and a back portion 108 extending upwards from the middle portion 104. The front portion 106 may include a front portion end, and the back portion may include a back portion end. The front and back portions 106, 108 may each extend upwards from the middle portion 104 at any suitable angle (e.g., a 90 degree angle, an angle greater than 90 degrees, an angle less than 90 degrees, etc.).

The portions of the support wire 102 may be integral (e.g., formed from a single length of wire, etc.). The portions of the support wire 102 may be defined by a bend 110 between portions. For example, a support wire 102 may include bends 110 between the middle portion 104 and the front and back portions 106, 108. The bends 110 may be formed by bending a support wire 102 at a predefined location.

The support wires 102 may have any suitable shape, including a circular cross section, a rectangular cross section, etc. The support wires 102 may have a thickness that is sufficient to provide support for items stored in the basket 101, other wires coupled to the support wires 102, etc. For example, the support wires 102 may have a thickness (e.g., diameter, etc.) of about 2.8 millimeters (mm), about 5.8 mm, etc. The support wires 102 may be spaced at any suitable distance to support items stored in the basket 101, to support other wires coupled to the support wires 102, etc. Although FIG. 1 illustrates three support wires 102, other embodiments may include more or less than three support wires 102.

The basket 101 also includes base wires 112 (broadly, base members). The base wires 112 may be substantially parallel to one another. The base wires 112 may be substantially perpendicular to the plurality of support wires 102. Each base wire 112 has a middle portion 114, a first end portion 116 extending upwards from the middle portion 114, and a second end portion 118 extending upwards from the middle portion 114. The first and second end portions 116, 118 may extend from the middle portion 114 at any suitable angle. Similar to the support wires 102, the portions of the base wires 112 may be defined by one or more bends, may be defined by an integral length of wire, etc. The first end portion 116 has a first end, and the second end portion 118 has a second end.

The middle portion 114 of each base wire 112 is coupled to the middle portions 104 of each of the support wires 102. The base wires 112 and support wires 102 may be coupled using any suitable arrangement. For example, the base wires 112 may be soldered to the support wires 102, welded to the support wires 102, adhered to the support wires 102 using any suitable adhesive (e.g., glue, etc.), formed integrally with the support wires 102, etc. The support wires 102 may be positioned under the base wires 112 (as shown in FIG. 1) and/or above the base wires, etc. The support wires 102 may support the base wires 112.

Similar to the support wires 102, the base wires 112 may have any suitable shape, including a circular cross section, a rectangular cross section, etc. The base wires 112 may have a suitable thickness (e.g., a 2.8 mm diameter, a 5.8 mm diameter, etc.) to provide support for items in the basket 101, and may be spaced apart from one another by a suitable distance to inhibit (e.g., prevent, etc.) items from falling between the base wires 112. The base wires 112 may be the same or different as the support wires 102.

The basket 101 further includes back wires 120 (broadly, back members). The back wires 120 may be substantially parallel to one another. The back wires 120 may be substantially perpendicular to the support wires 102. The back wires 120 may be substantially parallel to the base wires 112.

Each back wire 120 is coupled to the back portion 108 of each support wire 102. Each back wire 120 may be coupled via any suitable coupling method (e.g., soldered, welded, adhered, integrally formed with, etc.) as described above relative to the base wires 112 and support wires 102. Similarly, each back wire 120 may have any suitable shape, thickness, length, etc. The back wires 120 may be spaced apart by any suitable distance. The back wires 120 may be the same as or different from the base wires 112 and/or the support wires 102.

The basket 101 also includes front wires 122 (broadly, front members). The front wires 122 may be substantially parallel to one another, may be substantially perpendicular to the plurality of support wires 102, may be parallel to the back wires 120 and/or the base wires 112, etc.

Each front wire 122 is coupled to the front portion 106 of each support wire 102. The front wires 122 may be coupled using any suitable coupling technique (e.g., soldered, welded, adhered, integrally formed with, etc.) as described above. The front wires 122 may also have any suitable shape, thickness, length, spacing, etc., as described above. The front wires 122 may be the same as or different from the support wires 102, the back wires 120, the base wires 112, etc.

The basket 101 also includes a first rim wire 124 (broadly, a first rim). The first rim wire 124 is coupled to the front portion ends of the support wires 102 and the back portion ends of the support wires 102. The first rim wire 124 may be coupled using any suitable coupling technique (e.g., soldered, welded, adhered, integrally formed with, etc.) as described above.

The first rim wire 124 may be perpendicular to the support wires 102, and may be parallel to the base wires 112, the back wires 120, and/or the front wires 122. The first rim wire 124 may extend in a continuous loop around the top of the basket 101. The first rim wire 124 may include one or more bends such that the first rim wire 124 does not lie in a single plane where the front portion of the first rim wire 124 extends downwards from the rest of the first rim wire 124.

The first rim wire 124 may have any suitable shape, thickness, length, etc. The first rim wire 124 may be the same as or different from any of the other wires in the basket 101.

The basket 101 also includes a second rim wire 126 (broadly, a second rim) coupled to the first ends of the base wires 112. The second rim wire 126 may be substantially parallel to the first rim wire 124. Ends of the second rim wire 126 may be coupled to one or more of the support wires 102. The second rim wire 126 may be coupled using any suitable method (e.g., soldered, welded, adhered, integrally formed with, etc.) and may have any suitable shape, thickness, length, etc. The second rim wire 126 may be the same as or different from any one of the other wires.

The basket 101 further includes hook portions 128 extending upwardly from the second rim wire 126. The hook portions 128 may be integrally defined by or between end portions of two base wires 112. As shown in FIG. 1, the hook portions 128 may be engaged with (e.g., hooked onto, etc.) the supports 136, which, in turn, are coupled to slide rails 134 of the rail assemblies 103. Accordingly, the hook portions 128 and supports 136 may be used to couple the basket 101 to the rail assemblies 103 such that the basket 101 is supported between and suspended from the two rail assemblies 103.

Figure 11:
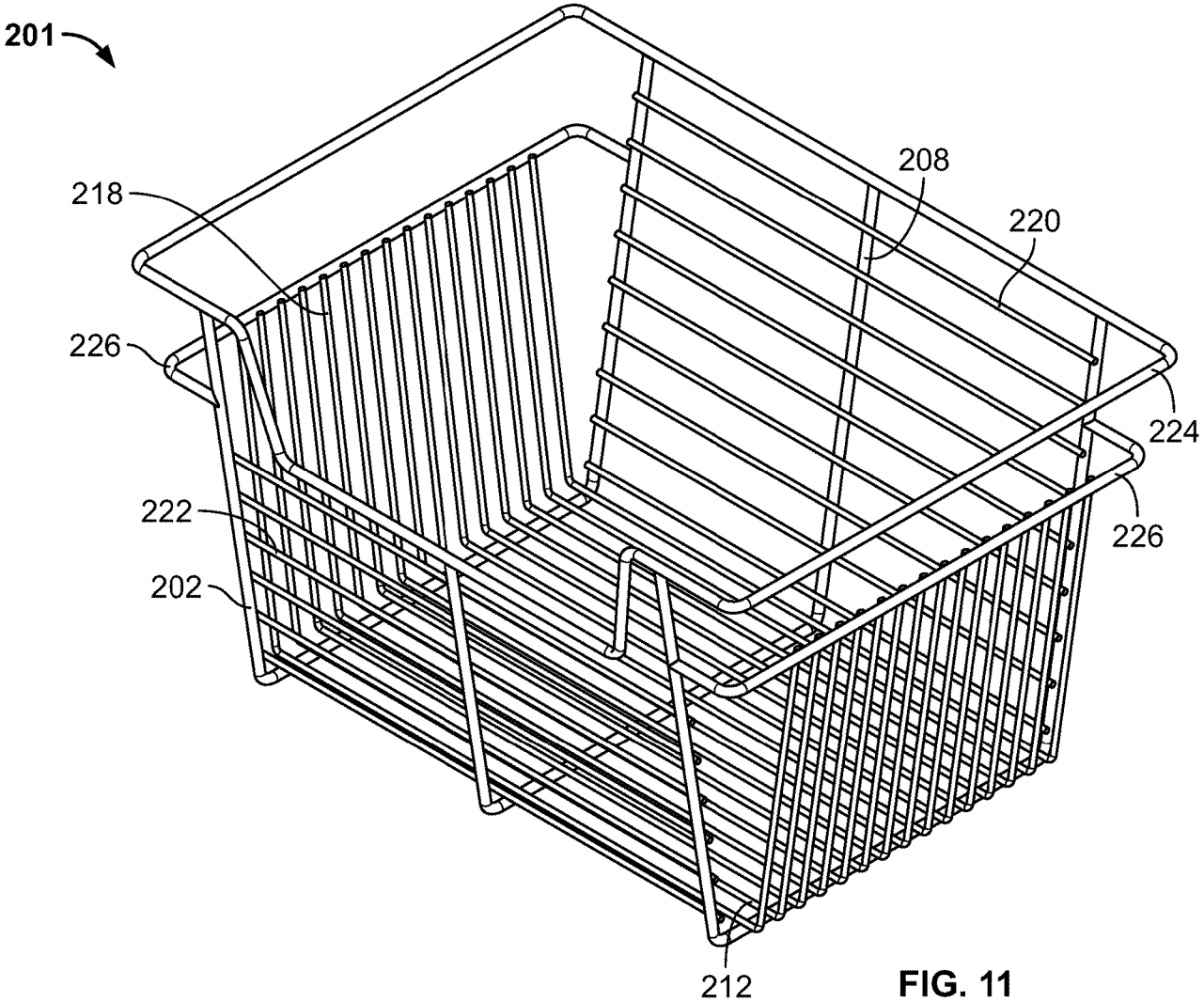
FIG. 11 is a perspective view of a basket according to an exemplary embodiment.

Although FIG. 1 illustrates a specific number and arrangement of wires, other embodiments may include a different configuration, such as more or less support wires 102, base wires 112, front wires 122, back wires 120, and/or rim wires 124, 126. For example, FIG. 11 illustrates a basket 201 that does not include any hook portions 128. Also, the wires may be arranged differently (e.g., spaced differently, etc.) than what is shown in FIG. 1. Each wire may be made of any suitable material. In FIG. 1, the base wires 112, front wires 122 and back wires 120 are illustrated as similar, while the support wires 102 and rim wires 124, 126 are also illustrated as similar. In other embodiments, different wire types may be used in any location.

With continued reference to FIG. 1, the basket and rail assembly 100 includes two rail assemblies 103. The rail assemblies 103 support the basket 101 therebetween. Each rail assembly 103 includes a mounting rail 130. The mounting rail 130 includes a surface adapted for mounting to a support surface, such as a wall of a closet, etc. The mounting rail 130 may be configured for mounting to a support surface using any suitable mounting techniques, including fasteners (e.g., screws, bolts, etc.) adhesives, etc.

The rail assembly 103 also includes an intermediate rail 132 having a surface arranged to slidingly engage a surface of the mounting rail 130. For example, the intermediate rail 132 may slide along mounting rail 130 using any suitable hardware, including guides, wheels, ball bearings, etc.

The rail assembly 103 further includes a slide rail 134 having a surface arranged to slidingly engage the surface of the intermediate rail 132. Accordingly, the intermediate rail 132 may be disposed between the slide rail 134 and the mounting rail 130.

The slide rail 134, intermediate rail 132, and mounting rail 130 may be substantially similar in length such that when the rail assembly 103 is in a storage position, the lengths of each rail are approximately aligned. Other embodiments may include rails having different lengths.

Figure 12:
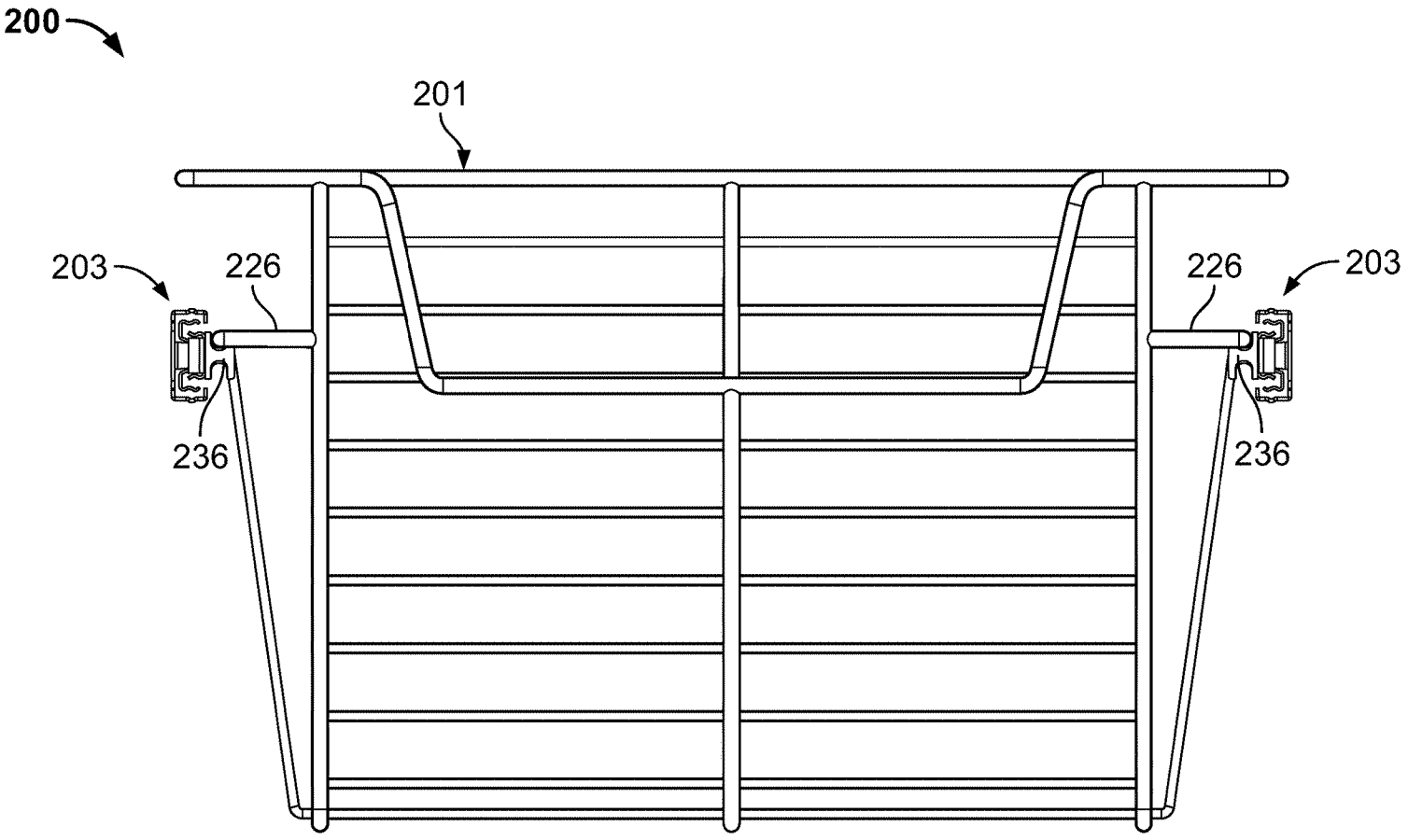
FIG. 12 is a front view of the basket shown in FIG. 11 where the basket is coupled between two rail assemblies according to an exemplary embodiment.

Supports or basket holders 136 are coupled to the slide rails 134 of the rail assemblies 103. The supports 136 are configured to releasably engage the basket 101 to support the basket 101 via the rail assemblies 103. For example, each support 136 may be releasably coupled to a corresponding one of the hook portions 128 of the basket 101. In other embodiments, the supports may couple directly to a rim wire of a basket. See, for example, the basket and rail assembly 200 shown in FIG. 12.

FIG. 1 illustrates two rail assemblies 103, with one rail assembly 103 on each side of the basket 101. Other embodiments may include more or less than two rail assemblies 103 and/or rail assemblies 103 positioned at different locations relative to the basket 101, etc.

FIG. 1 also illustrates two supports 136 on each slide rail 134. The supports 136 are positioned at opposite end portions of the slide rail 134. Other embodiments may include more or less than two supports 136 along a slide rail 134 and/or supports 136 located at different locations along a slide rail 134, etc.

Figure 3:
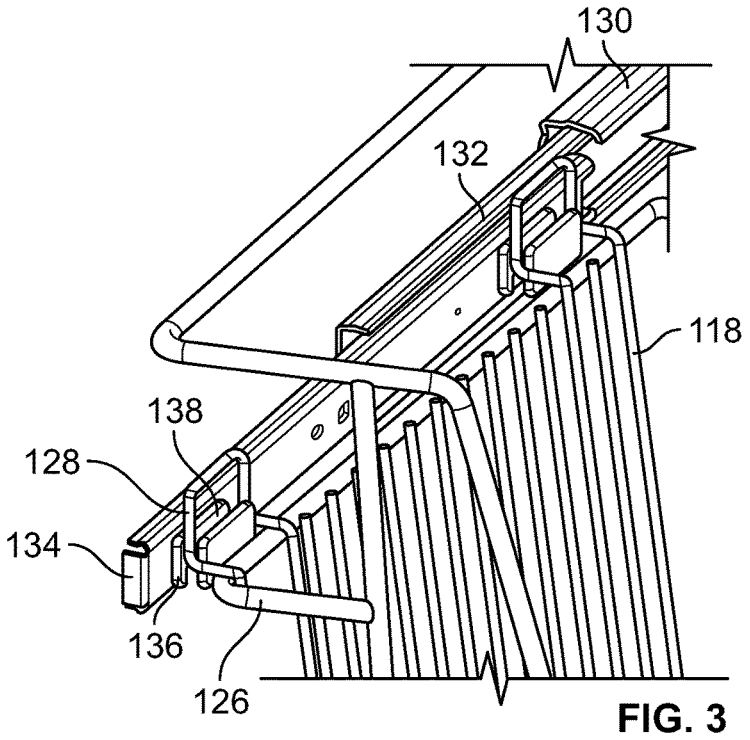
FIG. 3 is a perspective view showing a portion of the basket and rail assembly shown in FIG. 1, and illustrating two wire hook portions of the basket aligned to be positioned within grooves of two supports coupled to a slide rail of the rail assembly according to an exemplary embodiment.
Figure 4:
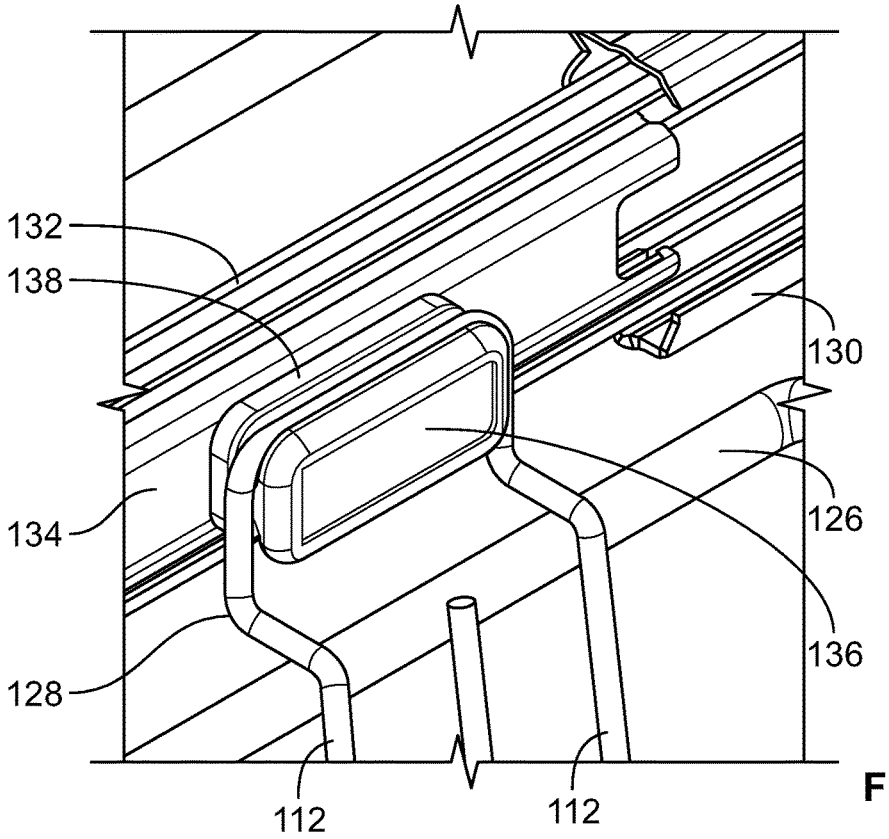
FIG. 4 is a perspective view showing a portion of the basket and rail assembly shown in FIG. 1 after the basket has been moved downward relative to the rail assembly to position the basket's wire hook portion within a groove of the support and thereby couple the basket to the rail assembly.
Figure 8:
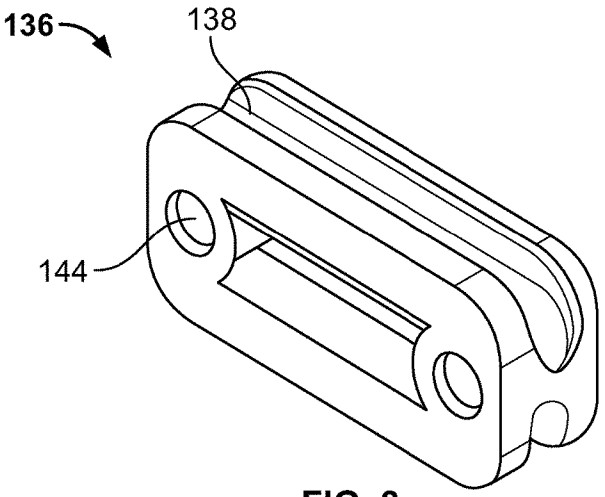
FIGS. 7 and 8 are front and back perspective views of a support shown in FIG. 1.
Figure 7:
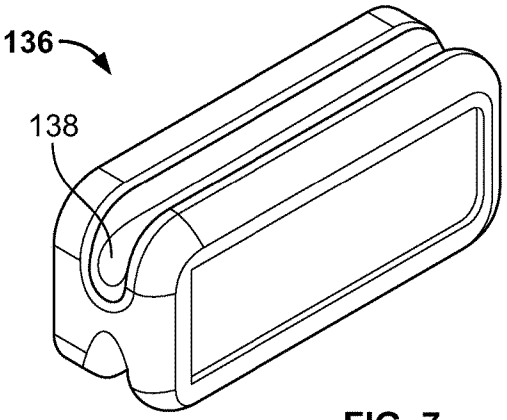
Figure 9:
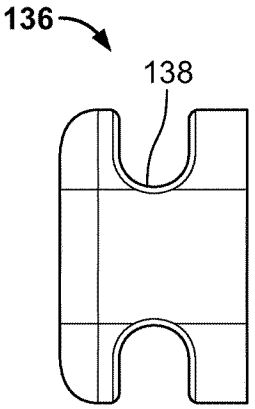
FIG. 9 is a side view of the support shown in FIG. 7.

FIGS. 3 and 4 illustrate hook portions 128 releasably coupled to the supports 136. Each support 136 may include a groove 138 configured to receive a hook portion. The groove 138 may thus be coupled to a hook portion 128 to thereby support at least a portion of the basket 101. The groove 138 may be parallel to the slide rail 134, intermediate rail 132, and mounting rail 130 (which rails 130, 132, 134 may also be parallel to one another). FIGS. 7, 8, and 9 illustrate a support 136 having two upper and lower grooves 138. Other embodiments may include supports 136 having more or less than two upper and lower grooves.

The wire hook portion 128 may extend from the rim wire 126 in any suitable direction. The wire hook portion 128 may have any suitable shape, including a rectangular shape, a circular shape, etc. The wire hook portion 128 may form a complete loop as shown in FIGS. 3 and 4, or the wire hook portion 128 may form a partial loop, etc. The wire hook portion 128 may be integrally formed from or with one or more base wires 112 as shown in FIG. 4.

Figure 5:
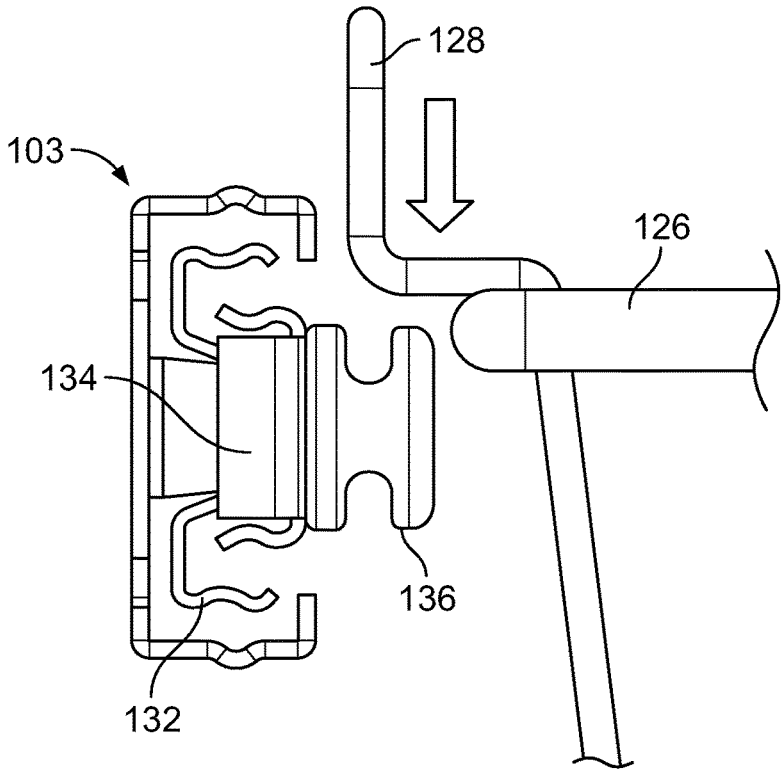
FIG. 5 is a front view of a portion of the basket and rail assembly shown in FIG. 3, and illustrating a wire hook portion of the basket aligned to be positioned within a groove of a support coupled to a slide rail of the rail assembly.
Figure 6:
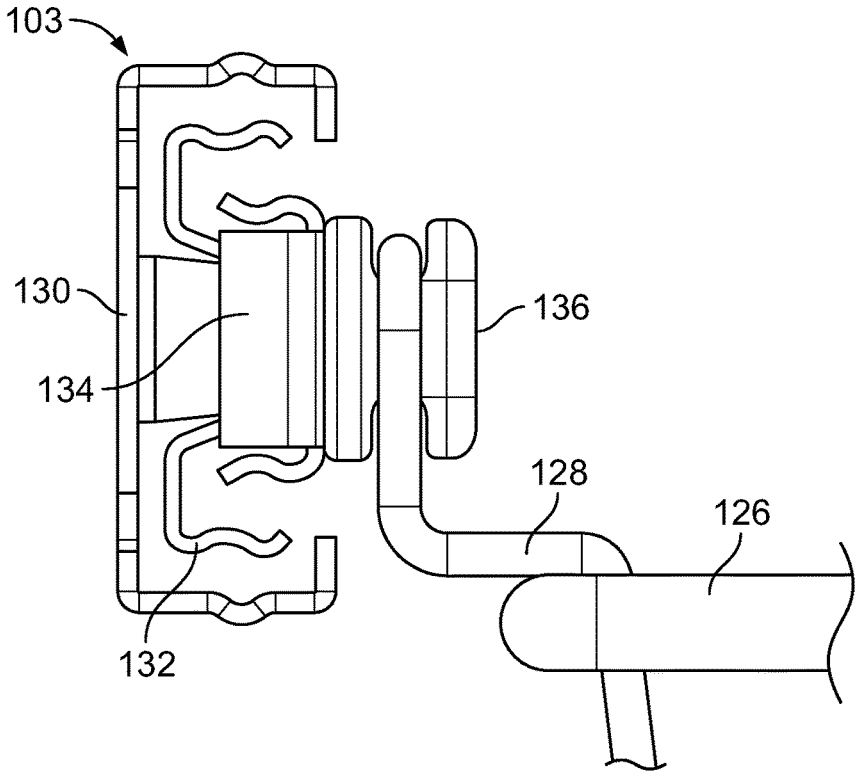
FIG. 6 is a front view showing the portion of the basket and rail assembly shown in FIG. 5 after the basket has been moved downward relative to the rail assembly to position the basket's wire hook portion within the groove of the supports and thereby couple the basket to the rail assembly.

As shown in FIGS. 5 and 6, each of the mounting rail 130, intermediate rail 132 and slide rail 134 may be substantially U-shaped. The rails 130, 132, 134 may be nested within one another, which may occupy less space, provide more stability and support for the rails 130, 132, 134, etc.

The groove 138 of the support 136 may correspond to the wire hook portion 128. The groove 138 may be sized such that an interference or friction fit is formed between the wire hook portion 128 and the support 136 when the wire hook portion 128 is inserted within the groove 138. The width of the groove 138 may be substantially similar to the width or diameter of the wire hook portion 128. For example, if the wire hook portion 128 has a diameter of about 2.8 mm, the groove 138 may also have a width of about 2.8 mm. The groove 138 may have any suitable cross-sectional shape (e.g., half-circle, semi-circle, rectangle, hexagon, etc.), which may correspond or match the cross-sectional shape of the wire hook portion 128. The supports 136 may be made of polypropylene, glass-filled polypropylene, acrylonitrile butadiene styrene, plastic, etc. and/or by an injection molding process, etc. Alternatively, the supports 136 may be made from other materials and/or by using other processes.

As shown in FIGS. 7, 8, and 9, the support 136 includes a groove 138 on each of the upper and lower sides. This may assist in installation as the support 136 can be oriented in either direction when coupled to the slide rail 134. Other embodiments may have more or less than two grooves 138 and/or grooves 138 positioned at different locations, etc.

Figure 10:
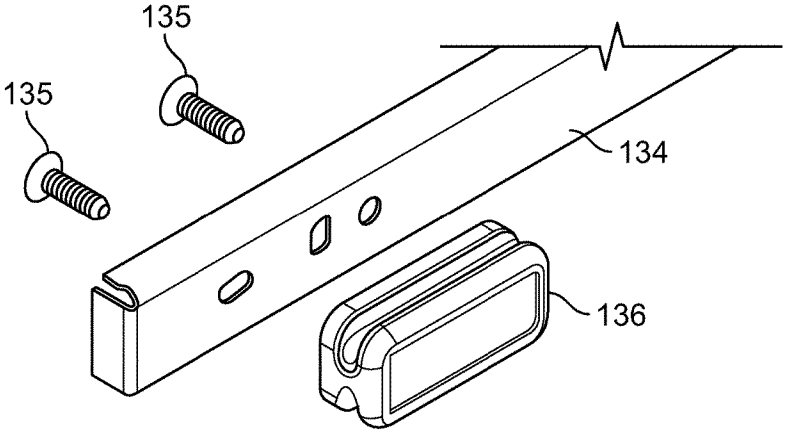
FIG. 10 is a perspective view illustrating an exemplary way the support shown in FIG. 7 may be coupled to a slide rail shown in FIG. 1 using screws.

As shown in FIG. 8, the support 136 also includes two holes 144. The holes 144 may be used for coupling the support 136 to a slide rail 134. The support 136 may be coupled to the slide rail 134 using any suitable fasteners (e.g., screws, bolts, etc.). For example, FIG. 10 shows the support 136 being coupled to the slide rail 134 using screws 135. Other embodiments may include more or less than two (including none) holes 144 and/or different ways of coupling the support 136 to the slide rail 134.

FIG. 11 illustrates another exemplary embodiment of a basket 201 embodying one or more aspects of the present disclosure. The basket 201 may include features or elements identical to or similar to the corresponding features or elements of the basket 101 shown in FIG. 1 and described above. For example, the basket 201 may also include support wires 202, base wires 212, back wires 220, front wires 222, and rim wires 224, 226. But the basket 201 does not include any integral wire hook portions as did the basket 101. Instead, the basket 201 may be coupled between two rail assemblies 203 by positioning the basket's rim wire 226 within the grooves 238 of the supports 236.

Figure 13:
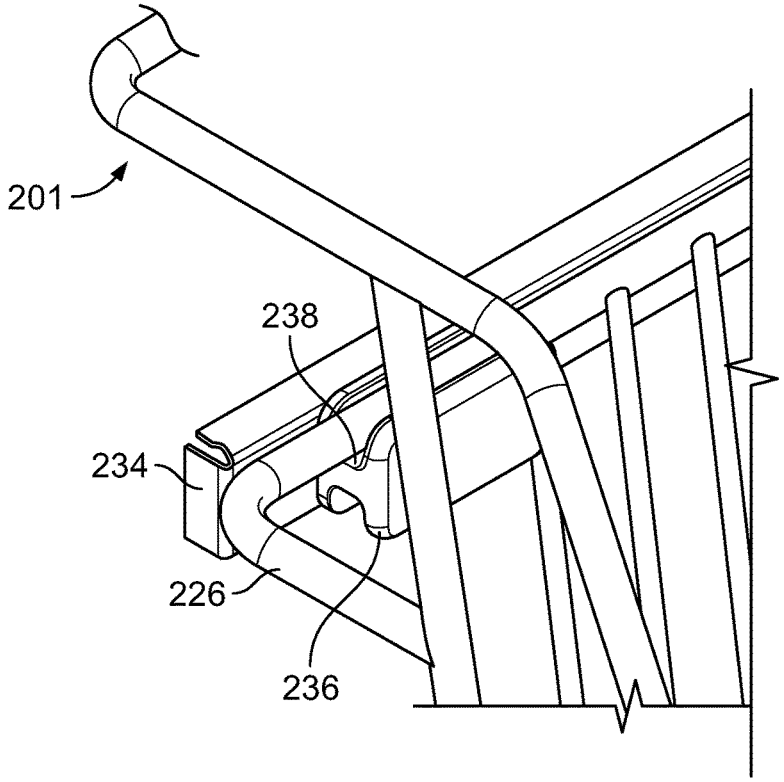
FIG. 13 is a perspective view showing a portion of the basket and rail assembly shown in FIG. 12, and illustrating a rim wire of the basket positioned within a groove of a support that is coupled to a slide rail of the rail assembly.
Figure 14:
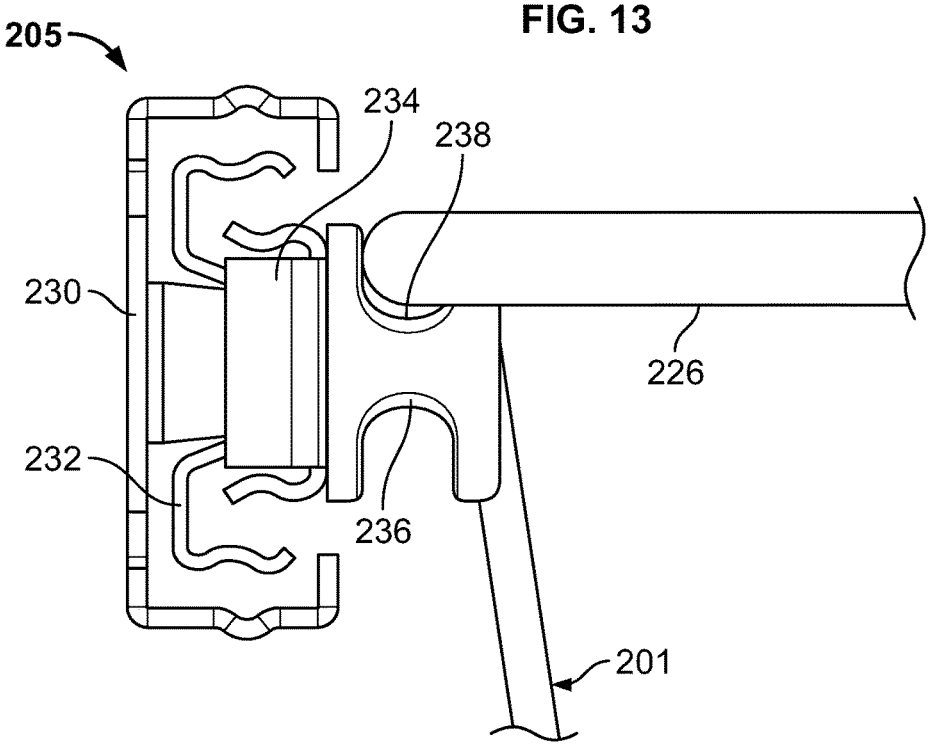
FIG. 14 is a front view of a portion of the basket and rail assembly shown in FIG. 13, and illustrating a rim wire of the basket positioned within a groove of a support that is coupled to a slide rail of the rail assembly.

For example, FIG. 13 shows the basket's rim wire 226 directly coupled to a support or basket holder 236. In contrast to what is shown in FIG. 4 where the basket's hook portions 128 are positioned within the grooves 138 of supports 136, FIG. 13 shows how the rim wire 226 of the basket 201 is positionable directly within a groove 238 of the support 236. Because the basket 201 does not include a hook portion 128, the rim wire 226 is positioned within the grooves 238 of the supports 236 to thereby couple and retain the basket 201 to the slide rails 234. The support 236 is similar to support 136, except that the groove 238 of the support 236 corresponds (e.g., in cross-sectional shape, width, etc.) to the rim wire 226 instead of a hook portion 128. The supports 236 may be made of polypropylene, glass-filled polypropylene, acrylonitrile butadiene styrene, plastic, etc. and/or by an injection molding process, etc. Alternatively, the supports 236 may be made from other materials and/or by using other processes.

The groove 238 may be sized such that an interference or friction fit is formed between the rim wire 226 and the support 236 when the rim wire 226 is inserted within the groove 238. The width of the groove 238 may be similar to the diameter of the rim wire 226. For example, if the rim wire 226 has a diameter of approximately 5.8 mm, the groove 238 may have a width of approximately 5.8 mm. The width of the groove 238 of support 236 may be greater than the diameter or width of the groove 138 of support 136 if the rim wire 226 has a greater diameter than the wire hook portion 128. The diameters of grooves 138 and 238 may be the same when the diameters of the rim wire 226 and the hook portion 128 are the same.

The rail assemblies 203 may be similar to or identical to the rail assemblies 103. Accordingly, each rail assembly 203 may include a mounting rail 230, an intermediate rail 232, and a slide rail 234. The mounting rail 230 may be configured to be mounted to a support surface. The intermediate rail 232 may have a surface arranged to slidingly engage a surface of the mounting rail 230. The slide rail 134 may have a surface arranged to slidingly engage the surface of the intermediate rail 232.

Figure 15:
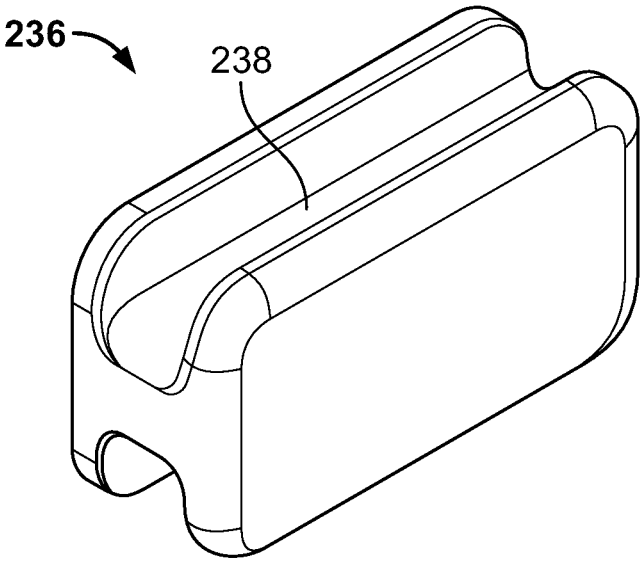
FIGS. 15 and 16 are front and back perspective views of the supports shown in FIGS. 12, 13, and 14.
Figure 16:
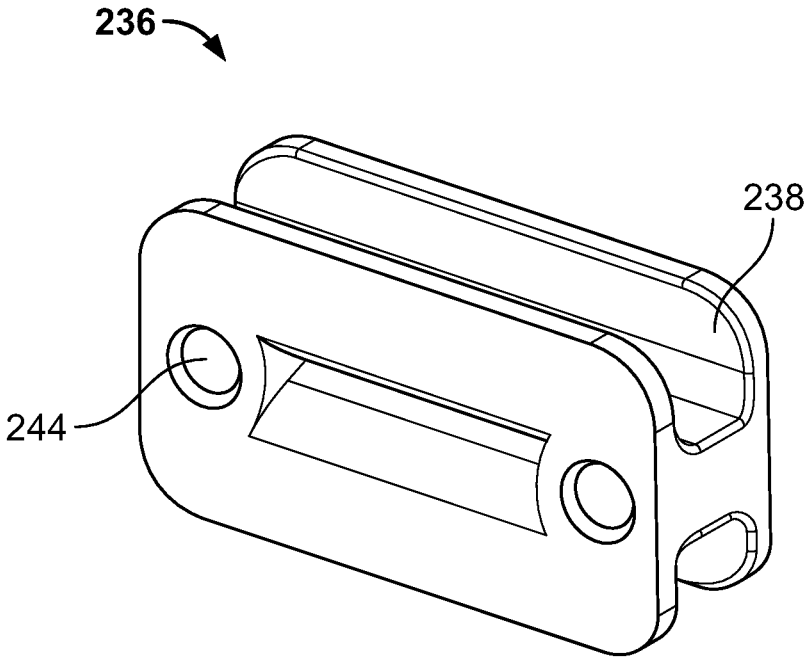

As shown by FIGS. 15 and 16, the support 236 includes a groove 238 on each upper and lower side. This may assist in installation as the support 236 can be oriented in either direction when coupled to the slide rail 234. Other embodiments may have more or less than two grooves 238 and/or grooves 238 positioned at different locations, etc.

The support 236 also includes two holes 244. The holes 244 may be used for coupling the support 236 to a slide rail 234. The support 235 may be coupled using any suitable fasteners (e.g., screws, bolts, etc.). Other embodiments may include more or less than two (including none) holes 244 and/or different ways of coupling the support 236 to the slide rail 234.

Figure 17:
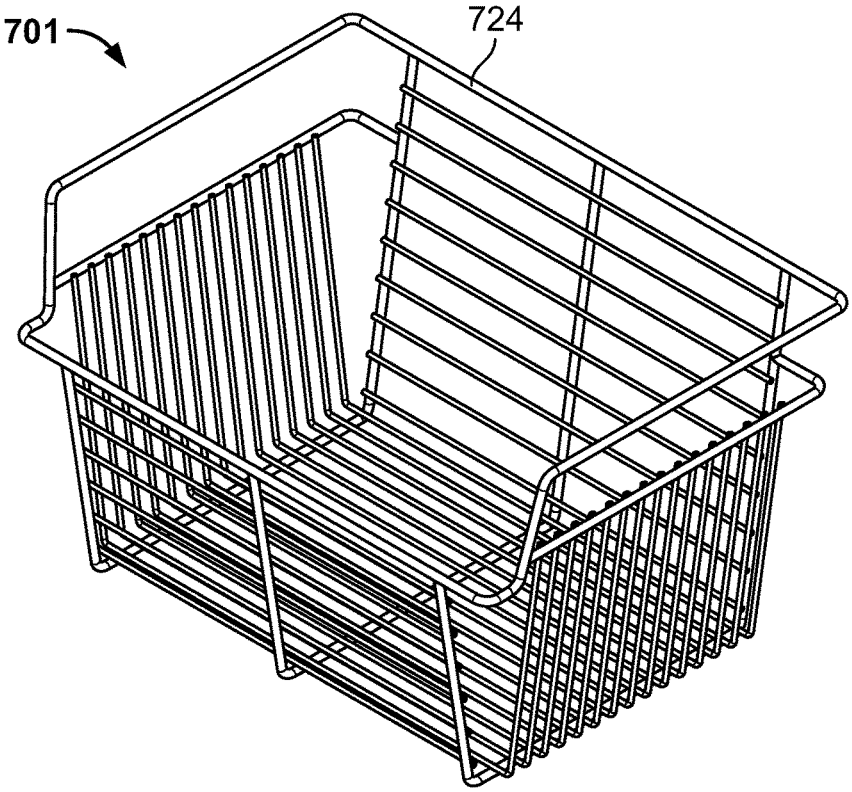

FIG. 17 illustrates an exemplary embodiment of a basket 701, which may be similar to the basket 201 of FIG. 11. But the basket 701 has a different upper rim wire 724. For example, the upper rim wire 724 extends downwards on the sides of the basket 701 instead of the front of the basket.

Figure 18:
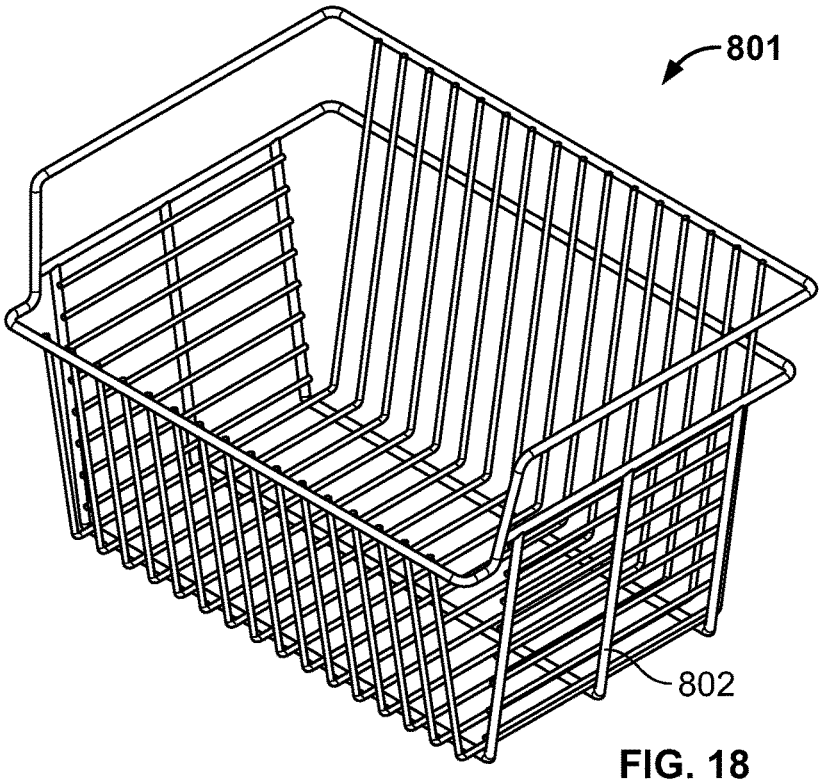

FIG. 18 illustrates an exemplary embodiment of a basket 801, which is similar to the basket 701 shown in FIG. 17. But the basket 801 has a different orientation of the support wires 802.

Figure 19:
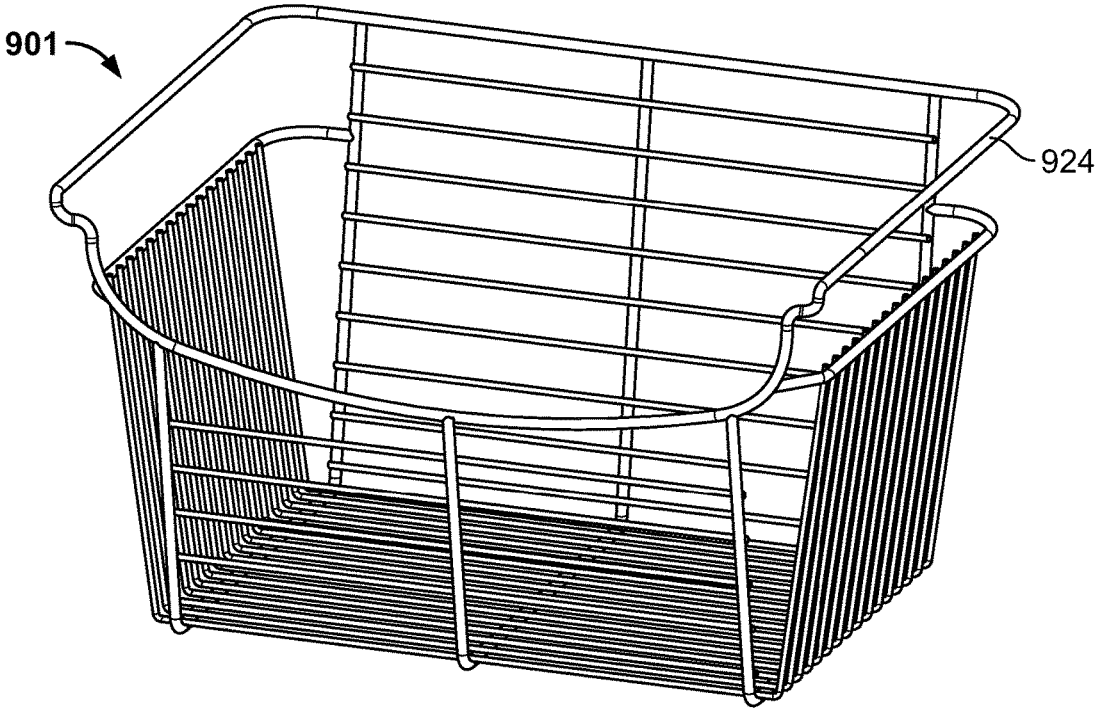

FIG. 19 illustrates an exemplary embodiment of a basket 901, which is similar to the basket 701 shown in FIG. 17. But the basket 901 has a different upper rim wire 924. For example, the upper rim wire 924 includes a downwardly curved portion on a front of the basket 901.

Figure 20:
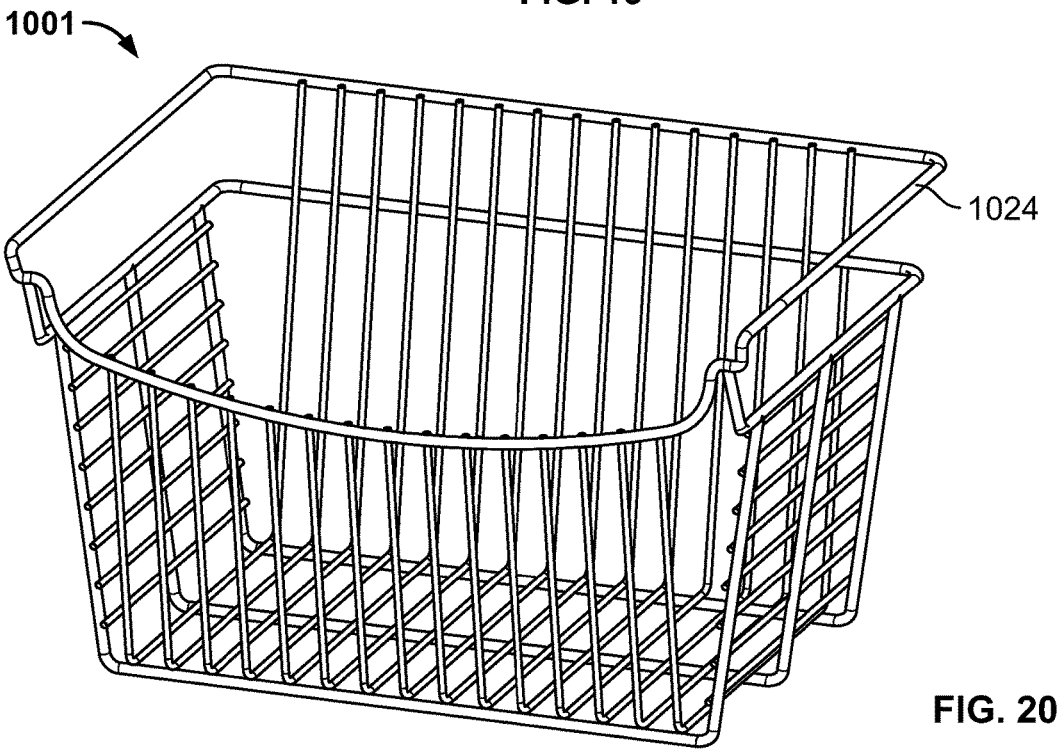

FIG. 20 illustrates an exemplary embodiment of a basket 1001, which is similar to the basket 801 shown in FIG. 18. But the basket 1001 has a different upper rim wire 1024. For example, the upper rim wire 1024 includes a downwardly curved portion on a front of the basket 1001.

FIG. 21 illustrates an example embodiment of a basket and rail assembly 1100 embodying one or more aspects of the present disclosure. As shown, the assembly 1100 includes a basket 1101 coupled to a rail assembly 1103 by hooks or hook supports 1146 (broadly, supports or holders).

As shown in FIGS. 22 and 23, the hook or hook support 1146 includes a groove 1148 for receiving a rim wire 1126 of the basket 1101. The hook 1146 includes holes 1150 for coupling the hook support 1146 to the slide rail assembly 1103, such as by using screws or other suitable fasteners.

An upper portion of the hook support 1146 is configured to be positioned generally over (e.g., snap fit over, etc.) the rail assembly 1103. The rim wire 1126 of the basket 1101 may be positioned within the groove 1148 of the hook support 1146 as shown in FIG. 23. The groove 1148 may be sized such that an interference or friction fit is formed between the rim wire 1126 and the support 1146 when the rim wire 1126 is inserted within the groove 1148. The width of the groove 1148 may be similar to the diameter of the rim wire 1126. For example, if the rim wire 1126 has a diameter of approximately 5.8 mm, the groove 1148 may have a width of approximately 5.8 mm.

The rail assembly 1103 may be similar to or identical to the rail assembly 103 shown in FIG. 1. Accordingly, the rail assembly 1103 may also include a mounting rail, an intermediate rail and a slide rail as described above.

The support 1146 may be made of polypropylene, glass-filled polypropylene, acrylonitrile butadiene styrene, plastic, etc. and/or by an injection molding process, etc. Alternatively, the support 1146 may be made from other materials and/or by using other processes.

FIG. 24 illustrates an example embodiment of a basket and rail assembly embodying one or more aspects of the present disclosure. As shown, the assembly includes a basket 1201 coupled to a rail assembly 1203 by hooks or hook supports 1252 (broadly, supports or holders). The basket 1201 may be identical to or similar to basket 801 (FIG. 18), basket 1001 (FIG. 20), basket 1101 (FIG. 21), etc. The rail assembly 1203 may be similar to or identical to the rail assembly 103 shown in FIG. 1. Accordingly, the rail assembly 1203 may also include a mounting rail, an intermediate rail and a slide rail as described above.

As shown in FIGS. 25 and 26, the support 1252 includes one or more outwardly projecting or extending portions 1256 (e.g., protrusions, protuberances, projections, detents, dimples, etc.). The portions 1256 may be configured to be positioned (e.g., snap fit, friction fit, engaged, inserted, etc.) within corresponding holes (FIG. 25) in the slide rail assembly 1203.

As shown in FIG. 24, the support 1252 includes a groove 1254 for receiving a rim wire 1226 of the basket 1201. An upper portion of the support 1252 is configured to be positioned generally over (e.g., snap fit over, etc.) the rail assembly 1203. The rim wire 1226 of the basket 1201 may be positioned within the groove 1254 of the support 1252. The groove 1254 may be sized such that an interference or friction fit is formed between the rim wire 1226 and the support 1252 when the rim wire 1226 is inserted within the groove 1254. The width of the groove 1254 may be similar to the diameter of the rim wire 1226. For example, if the rim wire 1226 has a diameter of approximately 5.8 mm, the groove 1254 may have a width of approximately 5.8 mm.

The support 1252 may be made of polypropylene, glass-filled polypropylene, acrylonitrile butadiene styrene, plastic, etc. and/or by an injection molding process, etc. Alternatively, the support 1252 may be made from other materials and/or by using other processes.

FIG. 28 illustrates an example embodiment of a basket and rail assembly embodying one or more aspects of the present disclosure. As shown, the assembly includes a basket 1301 coupled to a rail assembly 1303 by hooks or hook supports 1352 (broadly, supports or holders). The basket 1301 may be identical to or similar to basket 801 (FIG. 18), basket 1001 (FIG. 20), basket 1101 (FIG. 21), etc. The rail assembly 1303 may be similar to or identical to the rail assembly 103 shown in FIG. 1. Accordingly, the rail assembly 1303 may also include a mounting rail, an intermediate rail and a slide rail as described above.

The support 1352 includes a hook shaped or u-shaped portion 1353 defining a groove 1354. The groove 1354 is configured for receiving a rim wire 1326 of the basket 1301. An upper portion of the support 1352 is configured to be positioned generally over (e.g., snap fit over, etc.) the rail assembly 1303. The support 1352 also includes an elongate downwardly extending tab 1356 (broadly, a portion) for coupling the support 1352 to the rail assembly 1303. The rail assembly 1303 includes a slot 1358 (broadly, an opening) for slidably receiving the tab 1356 of the support 1352.

The groove 1354 may be sized such that an interference or friction fit is formed between the rim wire 1326 and the support 1352 when the rim wire 1326 is inserted within the groove 1354. The width of the groove 1354 may be similar to the diameter of the rim wire 1326. For example, if the rim wire 1326 has a diameter of approximately 5.8 mm, the groove 1354 may have a width of approximately 5.8 mm.

The support 1352 may be made of polypropylene, glass-filled polypropylene, acrylonitrile butadiene styrene, plastic, etc. and/or by an injection molding process, etc. Alternatively, the support 1352 may be made from other materials and/or by using other processes.

FIG. 33 illustrates an example embodiment of a basket 1401 and two supports or holders 1452 embodying one or more aspects of the present disclosure. As shown in FIG. 34, the basket 1401 may be coupled to a rail assembly 1403 by the supports 1452. The rail assembly 1403 may be similar to or identical to the rail assembly 103 shown in FIG. 1. Accordingly, the rail assembly 1403 may also include a mounting rail, an intermediate rail and a slide rail as described above.

The support 1452 defines a groove 1454 (e.g., a C-shaped or concave opening, etc.) configured for receiving a rim wire 1426 of the basket 1401. An upper portion of the support 1452 is configured to be positioned generally over (e.g., snap fit over, etc.) the rail assembly 1403. The support 1452 also includes holes 1450 (FIG. 35) for coupling the support 1452 to the rail assembly 1403 using fasteners (e.g., screws, etc.).

The groove 1454 may be sized such that an interference or friction fit is formed between the rim wire 1426 and the support 1452 when the rim wire 1426 is inserted within or press fit into the groove 1454. The width of the groove 1454 may be similar to the diameter of the rim wire 1426. For example, if the rim wire 1426 has a diameter of approximately 5.8 mm, the groove 1454 may have a width of approximately 5.8 mm.

The support 1452 may be made of polypropylene, glass-filled polypropylene, acrylonitrile butadiene styrene, plastic, etc. and/or by an injection molding process, etc. Alternatively, the support 1452 may be made from other materials and/or by using other processes.

FIG. 36 illustrates an example embodiment of a basket and rail assembly 1500 embodying one or more aspects of the present disclosure. As shown in FIG. 36, the assembly 1500 includes a basket 1501 having hooks or hook portions 1558 for coupling the basket 1501 to a rail assembly 1503. The rail assembly 1503 may be similar to or identical to the rail assembly 103 as shown I FIG. 1. Accordingly, the rail assembly 1503 may also include a mounting rail, an intermediate rail and a slide rail as described above.

As shown in FIG. 37, the hooks 1558 may be integrally defined by or between end portions of two base wires 1512. The hooks 1558 may extend upwardly relative to (e.g., beyond, from, etc.) the rim wire 1526 of the basket 1500. The hooks 1558 may be configured (e.g., with a generally upside down U-shape or hook shape, etc.) to be positioned generally over (e.g., hooked overtop of, etc.) the rail assembly 1503. As shown in FIG. 39, the rail assembly 1503 may include a spacer 1560.

FIG. 40 illustrates an example embodiment of a basket and rail assembly embodying one or more aspects of the present disclosure. As shown, the assembly includes a basket 1601 coupled to a rail assembly 1603 by hooks or hook supports 1652 (broadly, supports or holders). The basket 1601 may be identical to or similar to basket 201 (FIG. 11), basket 701 (FIG. 17), basket 901 (FIG. 19), etc. The rail assembly 1603 may be similar to or identical to the rail assembly 103 shown in FIG. 1. Accordingly, the rail assembly 1603 may also include a mounting rail, an intermediate rail and a slide rail as described above.

The support 1652 includes two end portions 1663 (e.g., U-shaped or hook shaped end portions, etc.) that respectively define two spaced-apart grooves 1654 (FIG. 42). The grooves 1654 are each configured for receiving the rim wire 1626 of the basket 1601 as shown in FIG. 40. The grooves 1654 may be sized such that an interference or friction fit is formed between the rim wire 1626 and the support 1652 when the rim wire 1626 is inserted within the grooves 1654. The width of each groove 1654 may be similar to the diameter of the rim wire 1626. For example, if the rim wire 1626 has a diameter of approximately 5.8 mm, the grooves 1654 may each have a width of approximately 5.8 mm.

The end portions 1663 of the support 1652 may be spaced apart such that the end portions 1663 are positioned on opposite sides of at least one base wire 1612 as shown in FIG. 40. The slide rail assembly 1603 includes tabs 1662 (e.g., stamped and bent sheet metal portions, integrally formed portions, etc.) for receiving the downwardly extending portions 1667 of the support 1652. In order to position the portions 1667 of the support 1652 between and underneath the tabs 1662, the portions 1667 of the support 1652 may be resiliently flexible. The portions 1667 may be compressively moved inwardly towards each other and then return to their original or initial position after being positioned underneath the tabs 1662. An upper portion 1669 of the support 1652 is configured to be positioned generally over (e.g., snap fit over, etc.) the rail assembly 1603.

FIGS. 43 and 44 illustrate a component or support 1671 (e.g., plastic part or insert, etc.) that may include the portions or tabs 1662. The component 1671 may be coupled to a slide rail assembly to thereby provide the portions 1662 for receiving the portions 1667 of the support 1652 shown in FIG. 42. As shown in FIG. 44, the component 1671 may include outwardly projecting or extending portions 1678 (e.g., protrusions, protuberances, projections, detents, dimples, etc.). The portions 1678 may be configured to be positioned (e.g., snap fit, friction fit, engaged, inserted, etc.) within corresponding holes of a slide rail assembly.

FIG. 45 illustrates an example embodiment of a basket and rail assembly embodying one or more aspects of the present disclosure. As shown, the assembly includes a basket 1701 coupled to a rail assembly 1703 by supports 1764 (broadly, supports or holders) and hooks or hook supports 1766 (broadly, supports or holders). The basket 1701 may be identical to or similar to basket 201 (FIG. 11), basket 701 (FIG. 17), basket 901 (FIG. 19), etc. The rail assembly 1703 may be similar to or identical to the rail assembly 103 shown in FIG. 1. Accordingly, the rail assembly 1703 may also include a mounting rail, an intermediate rail and a slide rail as described above.

The support 1764 may include a groove 1765 for receiving a hook 1766. The groove 1765 may be sized such that an interference or friction fit is formed between the hook 1766 and the support 1764 when the hook 1766 is inserted within the groove 1765. The width of the groove 1765 may be similar to the diameter of the hook 1766. For example, if the hook 1766 is made of a material having a diameter of approximately 5.8 mm, the groove 1765 may have a width of approximately 5.8 mm.

The hook or hook support 1766 includes two end portions 1763 (e.g., U-shaped or hook shaped end portions, etc.) that respectively define two spaced-apart grooves 1777 (FIG. 46). The grooves 1777 are each configured for receiving the rim wire 1726 of the basket 1701 as shown in FIG. 45. The end portions 1763 of the hook 1766 may be spaced apart such that the end portions 1763 are positioned on opposite sides of at least one base wire 1712. The grooves 1777 may be sized such that an interference or friction fit is formed between the rim wire 1726 and the hook support 1766 when the rim wire 1726 is inserted within the grooves 1777. The width of each groove 1777 may be similar to the diameter of the rim wire 1726. For example, if the rim wire 1726 has a diameter of approximately 5.8 mm, the grooves 1777 may each have a width of approximately 5.8 mm.

By way of example, the support 1764 may include holes 1768 for coupling (e.g., via screws 1769, etc.) to the slide rail assembly 1703 as shown in FIG. 48. Or, for example, the support 1764 may include one or more protrusions or protuberances 1770 (broadly, portions) as shown in FIGS. 49 and 50. The protrusions 1770 may be configured to be positioned within corresponding holes 1773 in the slide rail assembly 1703, for example, to guide the support 1764 to the proper position along the slide rail assembly 1703. The face 1775 of the support 1764 may be adhered (e.g., adhesively bonded, glued, etc.) to a surface of the slide rail assembly 1703.

The support 1764 may be made of polypropylene, glass-filled polypropylene, acrylonitrile butadiene styrene, plastic, etc. and/or by an injection molding process, etc. Alternatively, the support 1764 may be made from other materials and/or by using other processes.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A basket and rail assembly comprising:

a slide rail;

at least one support configured to be coupled to the slide rail, each support including a groove formed therein; and a basket comprising a plurality of wires including a plurality of support wires, a plurality of base wires, and at least one rim wire, the plurality of support wires being substantially parallel to one another, the plurality of support wires each being substantially U-shaped and having a first end portion, a second end portion, and a middle portion, the plurality of base wires substantially parallel to one another and substantially perpendicular to the plurality of support wires, the plurality of base wires each being substantially U-shaped and having a first end portion, a second end portion, and a middle portion, wherein the middle portion of each base wire is directly coupled to the middle portion of each of the plurality of support wires, wherein the at least one rim wire is coupled to and extends across at least one of the first and second end portions of each of the base wires, wherein at least one hook portion is integrally defined by two of the base wires at the first and second end portions thereof such that the at least one hook portion extends upwardly relative to the at least one rim wire, wherein the least one hook portion is configured to be positioned within the groove of the at least one support for releasably coupling the basket to the slide rail.

2. The basket and rail assembly of claim 1, wherein:

the at least one support comprises a plurality of supports; the at least one hook portion includes a plurality of hook portions each integrally defined by a corresponding pair of the plurality of base wires; and each said hook portion is configured to be positioned within the groove of a corresponding one of the plurality of supports.

3. The basket and rail assembly of claim 1, wherein:

the basket and rail assembly further comprises a mounting rail configured for mounting to a support surface and an intermediate rail arranged to slidingly engage the mounting rail; and the slide rail is arranged to slidingly engage the intermediate rail.

4. The basket and rail assembly of claim 1, wherein the at least one rim wire is a second rim wire; wherein the at the at least one rim wire further comprises a first rim wire coupled to and extending across at least one of the first and second end portions of each of the support wires, the first rim wire is above and substantially parallel to the second rim wire.

5. The basket and rail assembly of claim 1, wherein: the at least one support is configured to be mechanically fastened to the slide rail; and/or the at least one support is configured to be adhesively attached to the slide rail.

6. The basket and rail assembly of claim 2, wherein:

the plurality of hook portions extends upwardly relative to the at least one rim wire.

7. The basket and rail assembly of claim 2, wherein the at least one support comprises a plurality of supports configured to be coupled to the slide rail, each groove of the plurality of supports is configured to receive a corresponding one of the plurality of hook portions.

8. The basket and rail assembly of claim 1, wherein:

the basket and rail assembly further comprises a mounting rail configured for mounting to a support surface and an intermediate rail arranged to slidingly engage the mounting rail; and the slide rail is arranged to slidingly engage the intermediate rail.

9. The basket and rail assembly of claim 8, wherein:

the mounting rail is a first mounting rail, the intermediate rail is a first intermediate rail, and the slide rail is a first slide rail;

the basket and rail assembly further comprises a second mounting rail configured for mounting to a support surface, a second intermediate rail slidingly engaged to the second mounting rail, and a second slide rail slidingly engaged to the second intermediate rail; and the plurality of hook portions comprises:

a first plurality of hook portions along a first side portion of the basket for releasably coupling the first side portion of the basket to the first slide rail; and a second plurality of hook portions along a second side portion of the basket opposite the first side portion for releasably coupling the second side portion of the basket to the second slide rail.

10. A basket and rail assembly comprising:

a slide rail assembly including a mounting rail configured for mounting to a support surface, an intermediate rail arranged to slidingly engage the mounting rail, and a slide rail is arranged to slidingly engage the intermediate rail;

at least one support configured to be coupled to the slide rail assembly, the at least one support including at least one groove formed therein, wherein the groove is substantially parallel to the slide rail when the at least one support is coupled to the slide rail assembly;

a basket comprising a plurality of wires including a plurality of support wires, a plurality of base wires, and at least one rim wire, the plurality of support wires being substantially parallel to one another, the plurality of support wires each being substantially U-shaped and having a first end portion, a second end portion, and a middle portion, the plurality of base wires substantially parallel to one another and substantially perpendicular to the plurality of support wires, the plurality of base wires each being substantially U-shaped and having a first end portion, a second end portion, and a middle portion, wherein the middle portion of each base wire is directly coupled to the middle portion of each of the plurality of support wires, wherein the at least one rim wire is coupled to and extends across at least one of the first and second end portions of each of the base wires, wherein at least one hook portion is integrally defined by two of the base wires at the first and second end portions thereof such that the at least one hook portion extends upwardly relative to the at least one rim wire, wherein the least one hook portion is configured to be positioned within the groove of the at least one support for releasably coupling the basket to the slide rail assembly.

11. The basket and rail assembly of claim 1, wherein:

the at least one support is a first support;

the basket and rail assembly further comprises a second support configured to be coupled to the slide rail;

the second support is substantially parallel to the first support when the first and second supports are coupled to the slide rail.

12. The basket and rail assembly of claim 1, wherein:

the basket and rail assembly further comprises a first mounting rail configured for mounting to a support surface, and a first intermediate rail arranged to slidingly engage the first mounting rail;

the slide rail is a first slide rail arranged to slidingly engage the first intermediate rail; the at least one support is a first support coupled to the first side rail; the basket and rail assembly further comprises a second mounting rail configured for mounting to a support surface, a second intermediate rail slidingly engaged to the second mounting rail, a second slide rail slidingly engaged to the second intermediate rail, and a second support coupled to the second slide rail;

wherein the at least one hook portion includes a plurality of hook portions each integrally defined by a corresponding pair of the plurality of base wires;

and the plurality of hook portions comprises a first hook portion and a second hook portion, wherein the first hook portion is along a first side portion of the basket for releasably coupling the first side portion of the basket to the groove formed in the first support, and the second hook portion is along a second side portion of the basket opposite the first side portion for releasably coupling the second side portion of the basket to the groove formed in the second support.

* * * * *